US012515863B2

(12) United States Patent
Tollak

(10) Patent No.: US 12,515,863 B2
(45) Date of Patent: Jan. 6, 2026

(54) PACKED ROOF WINDOW PRODUCT, A METHOD FOR PACKING A PACKED ROOF WINDOW PRODUCT, AND A METHOD OF UNPACKING A PACKED ROOF WINDOW PRODUCT

(71) Applicant: VKR Holding A/S, Hørsholm (DK)

(72) Inventor: Tobias Tollak, Aarhus (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 18/699,285

(22) PCT Filed: Oct. 7, 2022

(86) PCT No.: PCT/DK2022/050210
§ 371 (c)(1),
(2) Date: Apr. 7, 2024

(87) PCT Pub. No.: WO2023/057031
PCT Pub. Date: Apr. 13, 2023

(65) Prior Publication Data

US 2024/0425258 A1 Dec. 26, 2024

(30) Foreign Application Priority Data

Oct. 8, 2021 (DK) ..... PA 2021 70504

(51) Int. Cl.
*B65D 77/04* (2006.01)
*B65B 5/10* (2006.01)
(Continued)

(52) U.S. Cl.
CPC ..... *B65D 77/042* (2013.01); *B65B 5/10* (2013.01); *B65B 69/00* (2013.01); *B65D 5/2052* (2013.01); *B65D 85/30* (2013.01); *E04D 13/03* (2013.01)

(58) Field of Classification Search
CPC ..... B65D 5/20; B65D 5/2052
(Continued)

(56) References Cited

U.S. PATENT DOCUMENTS 2,008,875 A 7/1935 Peterson et al.
6,189,777 B1 * 2/2001 Hutchinson ..... B65D 77/042 229/120.37
2008/0148692 A1 6/2008 Wisevercar et al.
(Continued)

FOREIGN PATENT DOCUMENTS

EP 1710163 10/2006
EP 2748071 4/2013
(Continued)

OTHER PUBLICATIONS

Roof Window Product (Year: 2021).*
(Continued)

*Primary Examiner* — Bryon P Gehman
(74) *Attorney, Agent, or Firm* — Merek, Blackmon & Voorhees, LLC

(57) ABSTRACT

A packed roof window product containing a plurality of window product related components packed in a box, wherein sub-packaging containing one or more components is provided with an attachment flap, and is retained in relation to another component by the attachment flap being arranged in an internal space of the other component, as a well methods for packing and unpacking such a packed roof window product.

20 Claims, 16 Drawing Sheets

(51) Int. Cl.

| | |
|---|---|
| ***B65B 69/00*** | (2006.01) |
| ***B65D 5/20*** | (2006.01) |
| ***B65D 85/30*** | (2006.01) |
| ***E04D 13/03*** | (2006.01) |

(58) Field of Classification Search
USPC ..... 229/120.37
See application file for complete search history.

(56) References Cited

U.S. PATENT DOCUMENTS

| | | | |
|---|---|---|---|
| 2014/0263595 | A1 | 9/2014 | Pantelleria |
| 2019/0002154 | A1 | 1/2019 | Hugley |
| 2022/0371771 | A1 | 11/2022 | Ghini |
| 2024/0425232 | A1 | 12/2024 | Henriksen |
| 2024/0426109 | A1 | 12/2024 | Tollak |

FOREIGN PATENT DOCUMENTS

| | | | |
|---|---|---|---|
| WO | WO2013050041 | 4/2013 | |
| WO | WO2014096146 | 6/2014 | |
| WO | WO-2021180288 A1 * | 9/2021 | ..... B65D 5/4208 |

OTHER PUBLICATIONS

International Search Report dated Dec. 16, 2022 issued in connection with International Application No. PCT/DK2022/050210, two (2) pages.
U.S. Appl. No. 18/699,289, filed Apr. 7, 2024.
U.S. Appl. No. 18/699,288, filed Apr. 7, 2024.
Non-Final Rejection dated May 13, 2025 issued in U.S. Appl. No. 18/699,288 (11 pages).

* cited by examiner

PACKED ROOF WINDOW PRODUCT, A METHOD FOR PACKING A PACKED ROOF WINDOW PRODUCT, AND A METHOD OF UNPACKING A PACKED ROOF WINDOW PRODUCT

TECHNICAL FIELD

The present invention relates to a packed roof window product comprising a plurality of differently sized roof window related product components accommodated in a box, wherein the box in a supply condition has a bottom side and a top side, which bottom side and top side are spaced apart along a height axis, and side walls of the box extend between the bottom side and top side of the box along the height axis, said bottom side, top side and side walls delimiting an internal space of the box, and wherein a first side wall extends along a primary axis, which primary axis is perpendicular to the height axis, and said first side wall has an upper edge extending along the primary axis along the top side, an outer surface facing away from the internal space, and an inner surface facing towards the internal space, wherein a first of said components comprises an internal space, delimited by internal surfaces of the first component, and wherein a second of the components or a collection of components is accommodated by a sub-packaging, the sub-packaging being accommodated in the box, the sub-packaging comprising a main body, which main body delimits an internal space accommodating the second component or component collection. The present invention further relates to a method for packing a packed roof window product, and a method of unpacking a packed roof window product.

BACKGROUND ART

When installing windows in a roof it is vital to ensure that the roof window itself is securely attached to the roof structure and that the joint between the roof window and the roof structure is properly weather proofed. It is therefore important that all components of roof window products, such as the roof window itself or a flashing assembly for a roof window, are used and are used in the right way. To facilitate this, the components are typically arranged in a box in an intended order of use and small components, such as screws, are kept in plastic bags. Furthermore, blocks of expanded polystyrene or similar shock absorbing material are used for protecting the product and/or for keeping the components in the intended position within the box. An example of a packed roof window, where these principles are used, is known from EP2748071B1 and an example of a packed flashing assembly for a roof window is known from EP1710163B1. Traditionally small components have been attached to the box or to larger components, for example by means of an adhesive, to prevent them from becoming lost, either inside the box or when removed from the box, and/or they have been accommodated by a sub-packaging, such as a plastic bag or a smaller box, thereby also preventing them from scratching or otherwise damaging other components. Larger components have traditionally been kept in place in the box by being attached to the box by means of an adhesive or by being fixated between blocks of expanded polystyrene (EPS), which blocks themselves either fill out the space in the box e.g. from one side to another or are glued to the box, and some have been covered by a protective plastic film to prevent them from being scratched.

While this has functioned well in terms of protecting the components, it has remained a problem that sometimes a sub-packaging move around in the box during handling and transportation, making them difficult to find when unpacking the roof window product and potentially causing damage to components of the product or to surfaces thereof. To solve this, sub-packagings as well as components have been attached to the box by glue or adhesives, but glue and adhesives are not easily removed from the packaging material and when recycling material comprising too much foreign matter it may lead to the material being classified as a lower grade of material, and hence e.g. being combusted rather than recycled.

SUMMARY OF INVENTION

With this background, it is an object of the invention to provide a packed roof window product with improved recyclability without increasing the risk of errors in the installation of the product and while maintaining a good protection of the components during transportation.

These and further objects are achieved by a first aspect of the invention providing a packed roof window product of the kind mentioned in the introduction, which is furthermore characterised in that the sub-packaging comprises an attachment flap projecting from the main body, and that the sub-packaging is retained in relation to the first component by the attachment flap being positioned in the internal space of the first component.

By providing a sub-packaging with an attachment flap, the sub-packaging can be attached to the first component, which keeps the sub-packaging in place in the box. Hence, separate fastening means for the sub-packaging are eliminated, potentially reducing the number of packaging pieces, which increases the likelihood of the packaging material being recycled by reducing the need for the installer to collect and sort different types of packaging after installing the window.

The main body and the attachment flap can be made from the same material to improve the recyclability. In a presently preferred embodiment, the entire sub-packaging is made from a paper-based material.

Attaching the sub-packaging to the first component also allows the first component and second component or component collection to be retrieved from the box as a unit, and hence components, which are to be used alongside the first component, can be packed in the sub-packaging. In this way the installer has the required components at hand when installing the first component.

Another potential advantage of having the sub-packaging retained in relation to the first component is that the sub-packaging may be used as a positioning element for the first component in the box, for example by spacing the first component to another component or the side wall of the box.

Suitably, the sub-packaging is retained in relation the first component by the attachment flap or a section thereof being constrained in the internal space of the first component. The constrained state arises when the section is restricted under tension between internal surfaces of the internal space of the first component. Corrugated cardboard is a suitable material as it has sufficient flexibility to allow it to be deformed when positioned in the internal space of the first component, but also sufficient rigidity for it to retain its position once positioned inside the internal space.

The attachment flap is herein described with reference to a proximal end of the attachment flap which is adjacent to the main body of sub-packaging and a distal end opposite to the proximal end. The distal end of the attachment flap will generally be positioned inside the internal space of the first component, whereas the proximal end will generally be outside the internal space of the first component. The distal end comprises a free edge of the attachment flap.

The box may be of a rectangular configuration where the top side and bottom side extend in parallel to each other and four side walls extend perpendicularly thereto in between the bottom and top sides. In such a case the height axis is parallel with the side walls and two side walls extend along the primary axis and the remaining two side walls extend along a secondary axis, which is perpendicular both to the height axis and to the primary axis. The primary and secondary axis may be denoted a longitudinal axis and a transverse axis, respectively.

The box is suitably a flat box, wherein the top side and bottom side form major sides of the box and the side wall are minor sides. Major and minor here refers to the relative area of the respective sides. In flat boxes a height of the box is smaller than the other dimensions, i.e. length and width. The width may be larger than the length.

The term supply condition denotes the packed state of the roof window product, in which it is supplied to the user. The box is described herein with reference to a bottom side and a top side with side walls extending in between. These terms are understood in terms of their function when packing the roof window product, the top side being the side which is open when packing the roof window product, allowing components to be packed in the box, and subsequently the top side is closed to provide the supply condition. The top side may also be denoted a lid of the box. The surfaces the box which face the internal space of the box in the supply condition are denoted as inner surfaces, whereas surfaces facing away from the internal space will be denoted as outer surfaces.

In some embodiments, a section of the attachment flap spans the internal space of the first component, a first edge of the section engaging an internal surface of the internal space of the first component at a first contact position P1 and a second edge of the section engaging another inner surface of the internal space of the first component at a second contact position P2, a distance Di being defined between the first and second contact positions P1, P2, and a length Ls being defined between the first and second edges of the section of the attachment flap, wherein the length Ls is equal to or greater than the distance Di.

In this way, the attachment flap is constrained between the first and second contact positions, whereby the sub-packaging is retained in relation to the first component. The constrained state of the attachment flap is strengthened by the length Ls exceeding the distance Di, whereby the section of the attachment flap is slightly deformed or bent, increasing the forces acting on the first and second contact position. For some materials one or more of the edges of the section of attachment flap may be compacted, similarly increasing the force acting on the contact positions.

The distance Di is the distance between contact positions P1 and P2 as measured in a cross-sectional plane perpendicular to a longitudinal extent of the first component. Similarly, the length Ls is the length of the trajectory of the section of the attachment flap extending between contact positions P1 and P2, as measured in the same cross-sectional plane. The first or second edge of the section may be an edge of a folding-zone in the attachment flap, which folding-zone is delimited by two edges. In such a case the length Ls is measured between a first edge of the folding-zone at contact position P1 and a second edge at contact position P2, where the first edge is the edge of the folding-zone which is closest to the second edge. The section of the attachment flap may span across the internal space or it may span along one or more of the internal surfaces.

Suitably, the attachment flap is folded inside the internal space of the first component and wherein a folding-zone of the attachment flap comprises the first and/or second edge. Folding the attachment flap provides an edge in addition to the edge at the distal end of attachment flap, which edges can engage the internal space of the first component to constrain the attachment flap therein. A folding-zone is part of the attachment flap at which the attachment flap folds or bends. Hence, sections of the attachment flap at either side of the folding zone extend in different directions. The folding-zone may be provided by perforating, scoring, or compressing or otherwise weakening the attachment flap to promote folding. The folding zone can be provided by weakening the material along one line, providing a relatively narrow folding zone. It could also be provided by two lines of weakening which are spaced apart, to provide a wider folding-zone, e.g. by two parallel scored lines in the attachment flap. A wide folding zone could also be provided by compression of the material of the attachment flap at the location where the folding-zone is intended to be. The folding-zone may assume a substantially linear extent or could assume a curved extent.

In some embodiments, the first component is a gutter-shaped element of a covering assembly or of a flashing assembly for a roof window.

Gutter-shaped components are typically used to drain off water, for example along the top of a roof window installed in an inclined roof, where a gutter placed under roofing tiles and on top of an underroof supported by the roof structure, drains water out onto flashing components extending along the side(s) of the window. The gutter-shaped component comprises a U-shaped cross-section formed by respective legs of the component, and the internal space is formed as a concave channel or trench between the respective legs. The legs of a U-shape may be curved or joined to each other at an angle. The channel or trench in the U-shape, i.e. internal space of the first component, may suitably have a rectangular cross section, potentially with rounded corners, which provides parallel surfaces between which the attachment flap can be constrained. Alternative cross-sections of the channel or trench in the U-shape could also be used, such as trapezoidal, or curved cross-section. Conceivably, a gutter element having a V-shaped cross section could also be used.

In one embodiment, the attachment flap has a proximal end adjacent to the main body of a sub-packaging and a distal end opposite to the proximal end and the gutter-shaped first component comprises a U-shaped cross-section, which U-shaped cross-section is formed by a first leg, a second leg and a third leg, the first and second leg being positioned at opposite sides of the internal space of the first component, and the third leg connects the first and second leg, wherein an open hem is provided at a free edge of the first or second leg, and the distal end of the attachment flap is arranged in the open hem.

By providing an open hem on the first component, the distal end of the attachment flap can be inserted in the open hem to retain the attachment flap in the internal space of the first component. The open hem may constitute the second contact position P2 described above, and a section of the flap may be constrained between the open hem and another contact position in the internal space of the first component. The open hem could alternatively retain the attachment flap by itself, by the distal end, fitting tightly in the open hem, constraining the distal end in the open hem. The term open hem refers to an edge which is bent in on itself or otherwise distanced from the leg of the first component, leaving a gap.

A closed hem conversely refers to a fold or the like where there is contact to the leg, leaving no gap. A closed hem could also provide a suitable contact position for an edge of the attachment flap.

Such hemming is common for metal components to reinforce the edge or hide sharp edges, and thus may not require specially designed components. Hems may be formed by folding the edge of the component, e.g. for sheet metal components, but could be also be formed as part of an extrusion process or the like.

In some embodiments the attachment flap is retained or constrained by the distal end of the attachment flap engaging the internal surface of the internal space of the first component at a corner formed by two internal surfaces joined at an angle to each other. Such a corner may for example be provided by making a leg of the first component with a bent edge forming a ledge extending at approximately 90 degrees from the leg. The term "joined at an angle" as used herein does not necessarily imply that the surfaces or legs are separate parts having been attached to form a combined element but refers to the surfaces or legs extending at an angle with respect to each other.

Such corners may provide a suitable contact position for an edge of the attachment flap, where the edge is less likely to slide on the internal surface.

In some embodiments, the attachment flap has a first section proximal to the main body and a second section distal to the main body, wherein the first section and second section are delimited from each other by a folding-zone of the attachment flap. Such an attachment flap can be retained in a first component having a U-shaped cross-section by the first and second section contacting the opposite legs at the free edges of the legs. The attachment flap will have a tendency to unfold at the folding zone, which may provide sufficient force acting on the first and second sections to keep them in contact with first component and retain the sub-packaging. This can be achieved e.g. by an attachment flap of corrugated cardboard, where the folding zone is a compressed zone of the attachment flap.

In some embodiments, the first component is carried by the first side wall of the box.

By the first component being carried by the side wall, the height dimension of the box may be used to a greater extent, allowing e.g. the width of the box to be reduced. Hence the material consumption can be reduced leading to a smaller climate footprint and potentially also to more flexibility in handling, storage, and transportation. A further potential advantage is that as the first component and hence also the sub-packaging is kept in place in the box by the side wall, auxiliary fastening means such as adhesives, tape or straps, may be eliminated, potentially rendering the packaging more suitable for easy recycling. It is understood that the first component is carried by the first side wall without the use of fastening means beyond the box itself, i.e. it may hang from or be suspended from the first side wall. The component may be said to be freely suspended from the first side wall. Hence, the first component is carried by the first wall by way of engagement between the first component and the side wall and possibly further panels of the box, such as a lid of the box when the box is closed.

The first component may generally be carried by the first side wall by a part of the side wall being arranged in the internal space of the first component.

In one embodiment, the first component is carried by the upper edge of the first side wall, and the attachment flap of the sub-packaging is folded across the upper edge from the inner surface of the first side wall to the outer surface of the first side wall.

By having the first component rest on the upper edge it is suspended from the side wall providing a position toward the top side of the box in the supply condition. In addition, when the box is closed in the supply condition, the lid of the box will be in contact with the first component, potentially preventing the first component from sliding along the side wall by friction between the first component and the lid. In this way the first component and hence also the sub-packaging is effectively fixed in the box without the use of auxiliary fastening means, beyond the box itself, potentially reducing the amount of packaging material used. The attachment flap is in such an embodiment arranged in between the internal surfaces of the first component and the upper edge of the first side wall.

The upper edge is a free upper edge of a panel of the box forming the side wall. The edge may the formed by a fold between two panels of the box or alternatively by being the extremity of the panel. The term "upper" denotes a position upwards along the height axis, i.e. toward the top side of the box. Suitably the first component is suspended from the upper edge by extending along the upper edge. The first component may engage and rest on the upper edge of the side wall, but particularly in embodiments where two or more sub-packagings are retained by the first component, the first component may rest on the attachment flaps thereof and not be in direct contact with the upper edge of the first side wall.

In one embodiment, a leg of the first component overlaps with the outer surface of the first side wall, and the lid of the box comprises an overlap panel, which overlap panel overlaps the outer surface of the first side wall in the supply condition, so that the overlapping leg of the first component is located between the first side wall and the overlap panel.

In this way the first leg of the first component is covered by the overlap panel and friction between the overlap panel and the component will reduce the tendency of the component to slide on the first side wall. The first leg may be said to sandwiched between the first side wall and overlap panel. The overlap panel may be a flap in the case of a 5-panel folder type cardboard box, or it may be a lid side wall in the case of telescope style cardboard box. In the closed state of the box the overlap panel is suitably fastened to the side wall, preferably by an adhesive.

A five-panel fold type box (sometimes referred to as five-panel-folder) is a standard box type, where fifth panel is provided to overlap with another panel in the closed state of the box. Telescopic boxes are also a standard box type, wherein the box comprises two pieces, which can be fitted to each other such that side walls of one piece is overlapped by side walls of the other piece.

In a further development, the overlap panel and/or the first side wall is provided with a zone of reduced thickness, such as a compressed zone, and this zone corresponds in size and shape at least to the first leg of the first component. The zone provides room for the first leg, which could otherwise prevent an adhesive used for attaching the overlap panel to the first side wall from attaching properly or later break the adhesive connection by pressing the overlap panel away from the side wall.

In a further development, the first side wall comprises a receiving section, and wherein the first component is carried by the receiving section. Suitably, the receiving section is a recess in the upper edge of the first side wall.

By providing a recess in the side wall the first component can be arranged in a retracted position in relation to the top side of the box, allowing the box to close in a flush manner. Furthermore, the first component can be arranged in between ends of the recess, which ends keeps the first component in place, preventing it from sliding along the side wall in the direction of the primary axis. In such an embodiment the recess has a length corresponding substantially to a length of the first component.

In some embodiments, the first side wall has a length L along the primary axis and the first component extends over 20 to 90% of the length L, preferably over 50 to 90% of the length L.

In some embodiments, the attachment flap extends through an opening in the first component into the internal space of the first component and a section of the attachment flap located inside the internal space of the first component has a length La, which is greater than a dimension Do of the opening in the first component, the length La and the dimension Do both extending in the same cross-sectional plane. The cross-sectional plane is perpendicular to the longitudinal extent of the first component, which longitudinal extent is parallel with the primary axis when first component is carried by the first side wall. The section of the attachment flap located inside the internal space of the first component may for example be the second section described above, the folding zone, or a section formed by the folding-zone and the second section together. By the section inside the internal space being longer than the dimension of the opening, the section of length La can act as anchor inside the internal space. For a component having a U-shaped cross-section the free edges of the first and second legs delimit the opening and the distance Do is the distance between the free edges in the cross-sectional plane.

In some embodiments, the box and/or the sub-packaging is/are made from a paper-based material such as paperboard or cardboard, preferably corrugated cardboard.

Cardboard and other paper-based material is readily recyclable and by providing all packaging elements made from such materials the likelihood of it being recycled is increased considerably as there is no need for sorting the packaging in fractions. Cardboard can also be made as a material which is suitably compressible for it to be forced into the internal space of the first component, and rigid enough for it to retain its position therein subsequently, to keep the sub-packaging in place. Corrugated cardboard can also easily be made to fold at pre-selected position by compression, perforation or scoring. In this way the length of the section to be restrained or constrained in the internal space can be pre-determined according to the dimensions of the internal space. Corrugated cardboard can also be made sufficiently rigid for the attachment flap to be retained by the distal end being inserted in an open hem of the first component as described above.

In one embodiment, the attachment flap is integrally formed with the main body of the sub-packaging. In this way the likelihood of the material of the sub-packaging material actually being recycled is increased considerably, while also simplifying manufacture of the sub-packaging.

In some embodiments, the sub-packaging comprises a removable portion configured for being separated from the rest of the sub-packaging by a break-zone. A break-zone is understood to be a portion of the sub-packaging which has been deliberately weakened to facilitate tearing, opening or the like of the sub-packaging. The break-zone may comprise perforations or scoring. By providing a removable portion, the installer can easily remove the sub-packaging from the first component. The removable portion may also provide the installer with a way to easily open the sub-packaging and access the component(s) accommodated in the sub-packaging.

In embodiments where the attachment flap is retained in the first component, but where it is sufficiently flexible for being removed therefrom without breaking, the removable portion could be configured to remain attached to the rest of the sub-packaging after the having been used to open the sub-packaging. In this way the sub-packaging is kept in one piece, increasing the likelihood of the material being collected for recycling.

The removable portion may comprise the attachment flap. When the removable portion includes the attachment flap, the break zone is provided at or in connection with the attachment flap. In this way, the break-zone provides a way of separating the main body from the attachment flap, which may thus be left behind in the first component. The break zone may be provided on a wall of the main body from which wall the attachment flap projects. The removable portion may cover at least 30% of the wall of the main body from which the attachment flap projects, preferably at least 50%. In this way the removable portion can provide an opening from which the components of the sub-packaging can be easily retrieved by the installer, which opening may be provided as the main body is separated from the first component. The coverage of the removable portion is calculated as the fraction of the area which is removed from the wall of the main body to the total area of the wall.

In some embodiments, the main body of the sub-packaging is box-shaped. Box-shaped is typically a rectangular prism shape. In alternative embodiment, sub-packaging comprises one or two open sides, the open sides facing along the primary axis. Such a main-body may have a tubular shape or pipe-shape. In a main body having two open sides, the open sides preferably face in opposite directions along the primary axis, allowing long components to be accommodated by extending through the main body. A main body with one open side can accommodate an end-portion of a component, and two sub-packagings can thus accommodate one component.

The sub-packaging may suitably be folded from a blank, e.g. of the five-panel fold type. In that case the attachment flap is provided as an extension of one of the side panels of the blank.

In some embodiments, the sub-packaging is a bag, such as a paper bag. The attachment flap may be provided an extension of part of the bag or a separate attachment flap, suitably of cardboard or corrugated cardboard, attached to the bag.

In an embodiment, the attachment flap comprises a thick portion, which thick portion has a thickness configured for being retained in the internal space of the first component. This can be achieved by the thickness of the thick portion corresponding to or slightly exceeding a distance between internal surfaces of the first component, whereby the thick portion can be held by tension between the internal surfaces. In embodiments where the first component is carried by the first side wall of the box, the thickness of the thick portion could be configured for being retained between an internal surface of the first component and a surface of the first side wall. The thick portion may be formed by folding the attachment flap onto itself or alternatively by attaching a piece of material, such as a piece of cardboard or corrugated cardboard, to the attachment flap to increase the thickness. The piece could be attached e.g. by an adhesive, glue or similar.

In some embodiments, the box is folded from one or more blanks, preferably a blank of the five-panel fold type or a blank of the telescopic type.

In another aspect of the invention, there is provided a method for packing a roof window product as described herein, which method comprises the steps of: arranging the sub-packaging in the box with the attachment flap extending across the first side wall from the inner surface to the outer surface, arranging the first component on the first side wall with the attachment flap positioned in the internal space of the first component, retaining the sub-packaging in relation to the first component.

When the attachment flap is positioned across the first side wall, and the first component is arranged thereon, the attachment flap will be positioned in the internal space, retaining or constraining the attachment flap therein.

In another aspect of the invention, there is provided a method of unpacking a packed roof window as described herein, which method comprises the steps of: removing the first component from the box, the sub-packaging being retained in relation to the first component, and removing at least a main body of the sub-packaging from the first component.

BRIEF DESCRIPTION OF DRAWINGS

In the following description embodiments of the invention will be described with reference to the schematic drawings in which.

DESCRIPTION OF EMBODIMENTS

Figure 1:
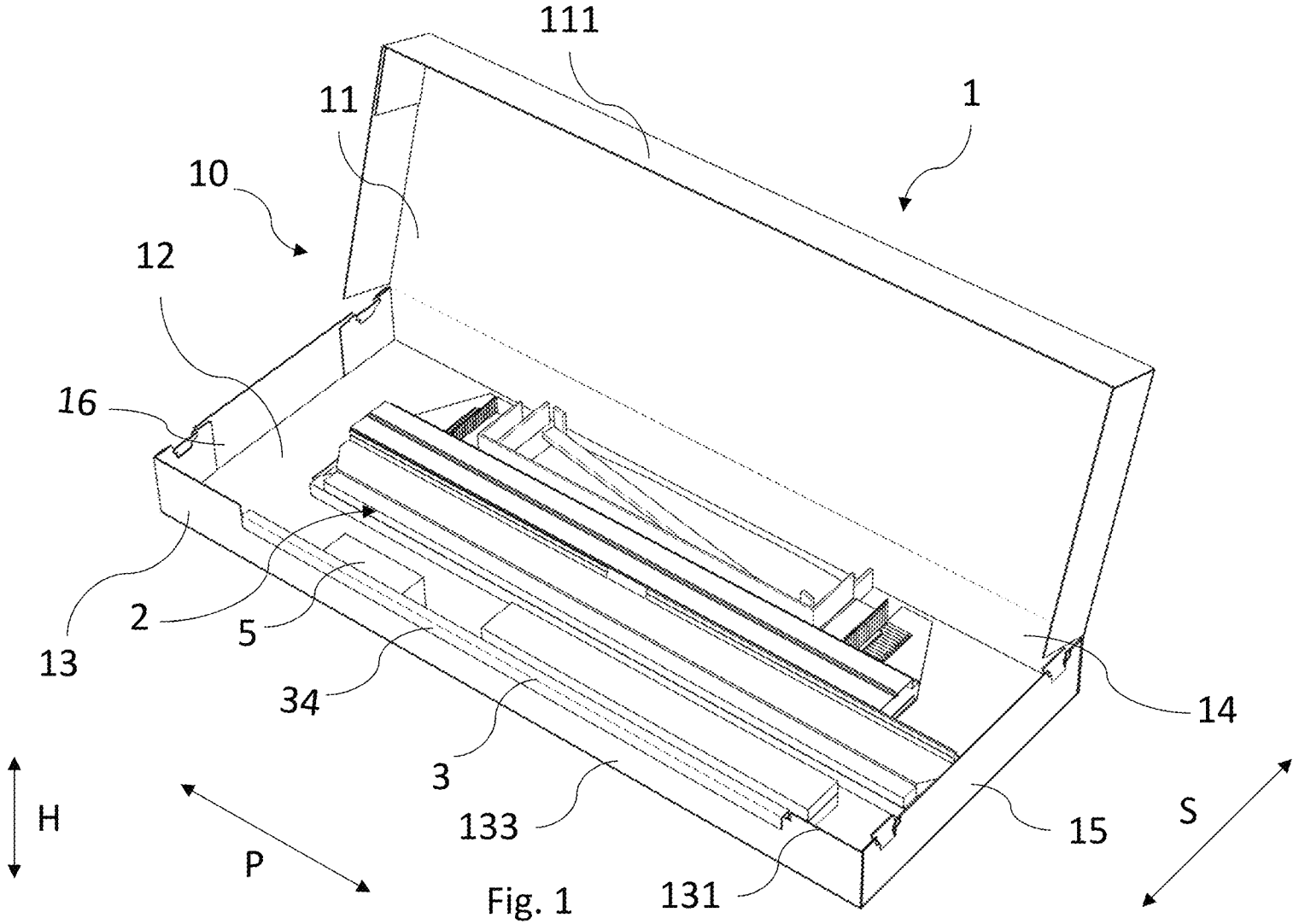
FIG. 1 is a perspective view from above of a cardboard box with an open lid accommodating a roof window product embodied by an installation kit.
Figure 16:
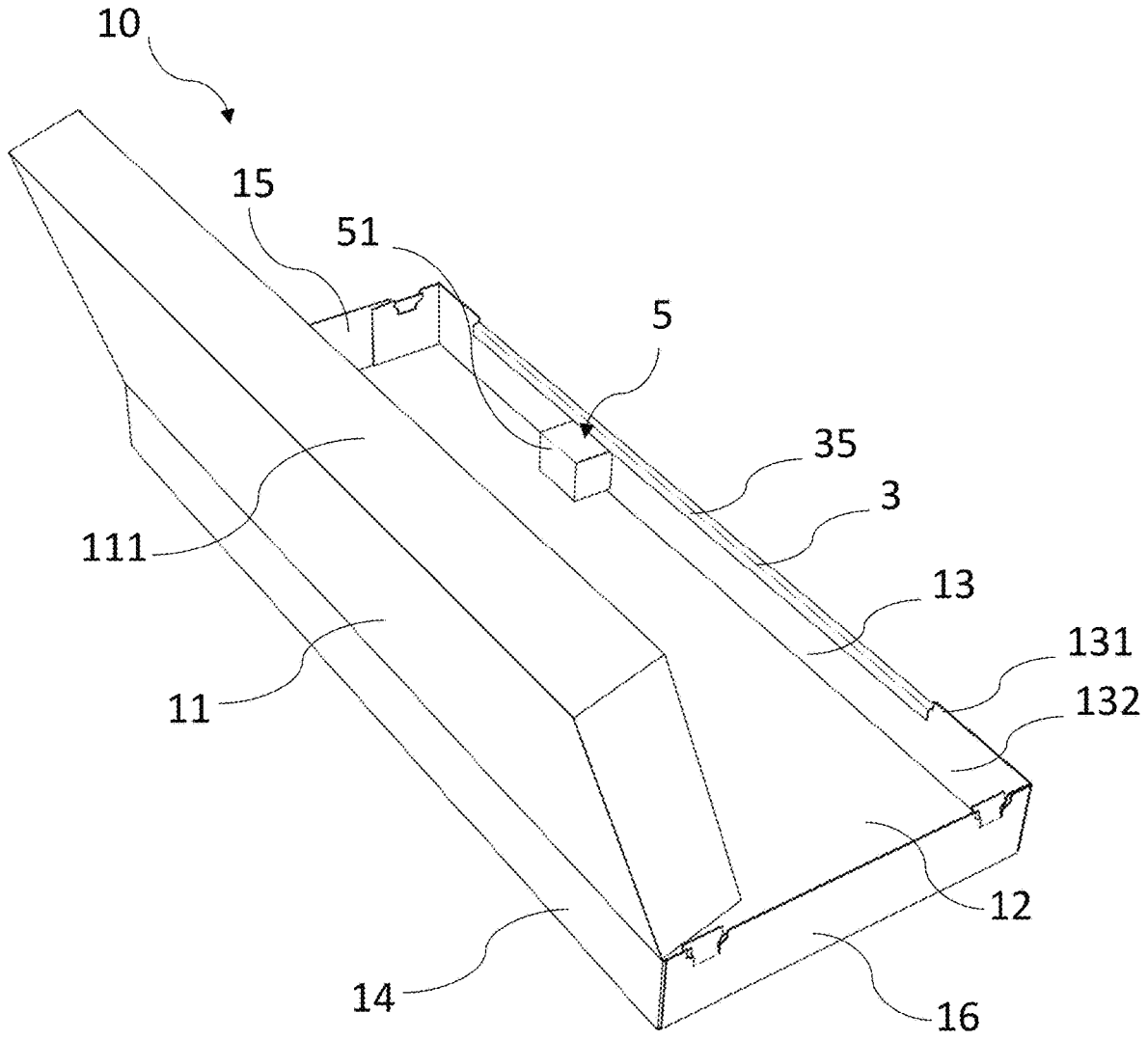
FIG. 16 shows the cardboard box of FIG. 1 from another angle without the plurality of components.

Referring initially to FIG. 1 which shows a perspective view from above of a packed roof window product 1 packed in a box 10 of cardboard and of the five-panel fold type. The cardboard box is shown in an open state where a lid forming the top side 11 is open. The box 10 has a rectangular configuration and has a bottom side 12 and a four side walls 13-16 which side walls extend along a height axis H which is perpendicular to the bottom side 12. A first of the side walls 13 and second side wall 14 extend between side walls 15-16 along a primary axis P. Side walls 15-16 extend along a secondary axis S, and both the primary P axis and secondary axis S are perpendicular to the height axis H and mutually perpendicular. The primary axis P is longitudinal, and the secondary axis S is transverse. The top 11 and bottom sides 12 are seen to be the major sides of the box. The box 10 has an internal space which accommodates a plurality of window product related components 2 where a majority of components are is placed on the bottom side 12. The components 2 include a flashing assembly and insulation frame side members, and a gutter element 3. The gutter element 3 embodies the first component and is carried by the first wall 13. The gutter element 3 is suspended from an upper edge 131 of the first side wall 13. The gutter element 3 has an internal space and has been arranged such that the first side wall 13 extends into the internal space. A collection of smaller components is accommodated by a sub-packaging 5, which is positioned at the first side wall 13 below the gutter element 3. An attachment flap (not visible in FIG. 1) is folded inside the gutter element 3 and across the first side wall 13 whereby the sub-packaging 5 is retained in relation to the gutter element 3, which in turn is retained in relation to the first side wall 13. Details on the positioning of the attachment flap in the gutter element is shown in the subsequent figures. See also FIG. 16 showing the box 10 from another angle without the collection of components 2.

Figure 2:
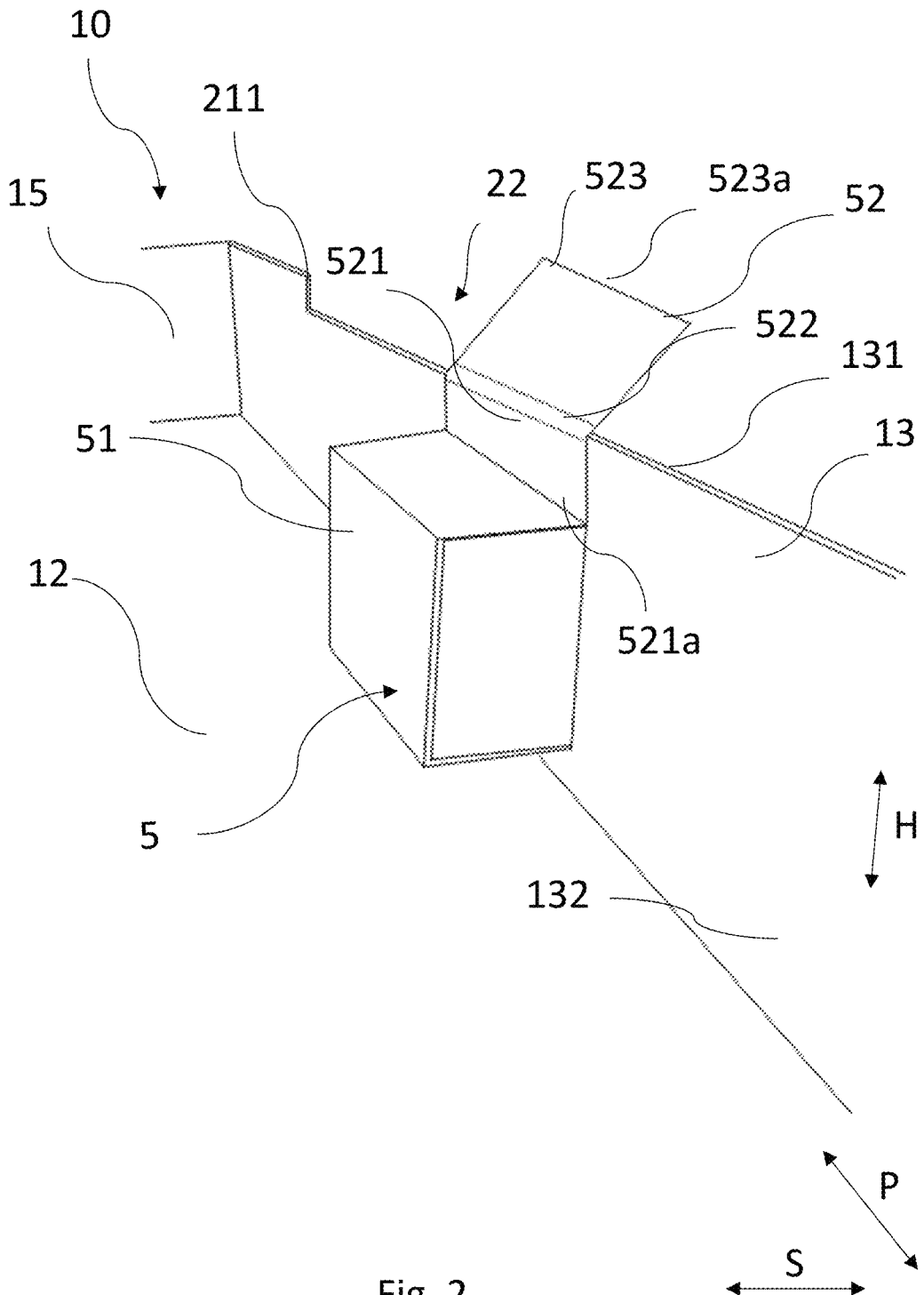
FIG. 2 is perspective view from inside of a box in the process of being packed showing the sub-packaging.

Referring now to FIG. 2 which shows details of a sub-packaging 5 in a box 10 before the gutter element 3 is mounted on the first side wall 13. The first side wall 13 has a receiving section formed by a recess 22 from which the gutter element 3 is to be suspended. The gutter element 3 will extend between two recess ends 211, which keeps the gutter element 3 from sliding along the side wall 13. In addition, the recess 22 provides a retracted position for the gutter element in relation to the top side 11 of box in the supply condition, allowing the top side to close in a flush manner. The sub-packaging is positioned next to the first side wall 13, with a main body 51 against the inner surface 132 of the first side wall, and an attachment flap 52 arranged to extend across the first side wall 13 from the inner surface 132 to the outer surface. The attachment flap 52 has a first section 521 extending between a proximal end 521*a* at the main body 51 and a folding zone 522, and a second section 523 extending from the folding zone 522 to a distal end 523*a* furthest from the main body 51. The first section 521 and second section 523 are thus delimited from each other by the folding zone 522, where the material has been compressed to promote folding. When the gutter element 3 is mounted in the recess 22, the second section 523 will fold down along the outer surface of the first side wall 13 and the attachment flap will be constrained in the internal space of the gutter element 3.

Figure 3A:
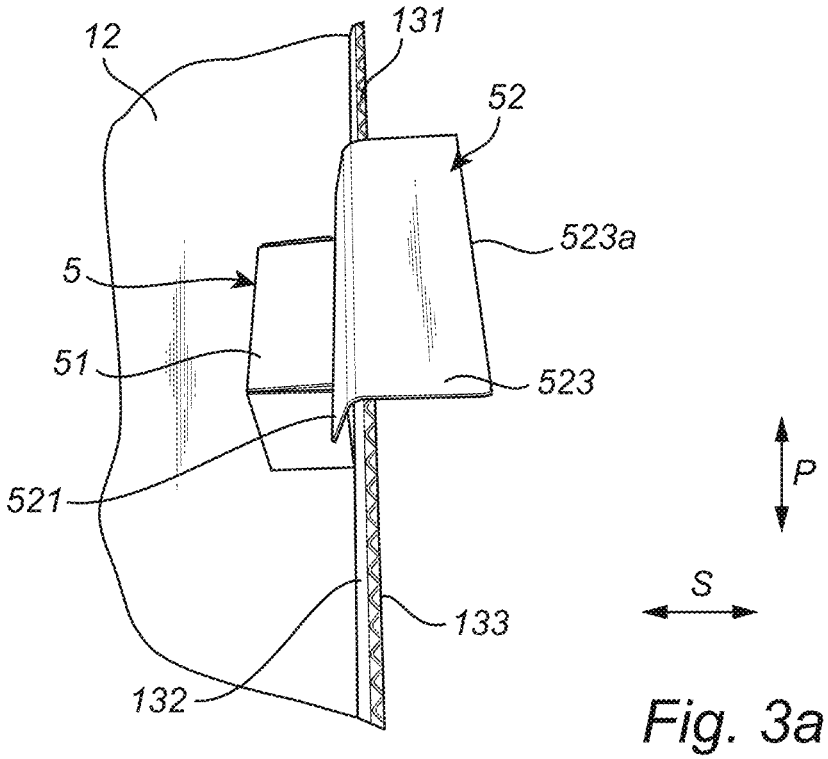
FIG. 3*a-b* are perspective views of a sub-packaging and first component being mounted on a first side wall.
Figure 3B:
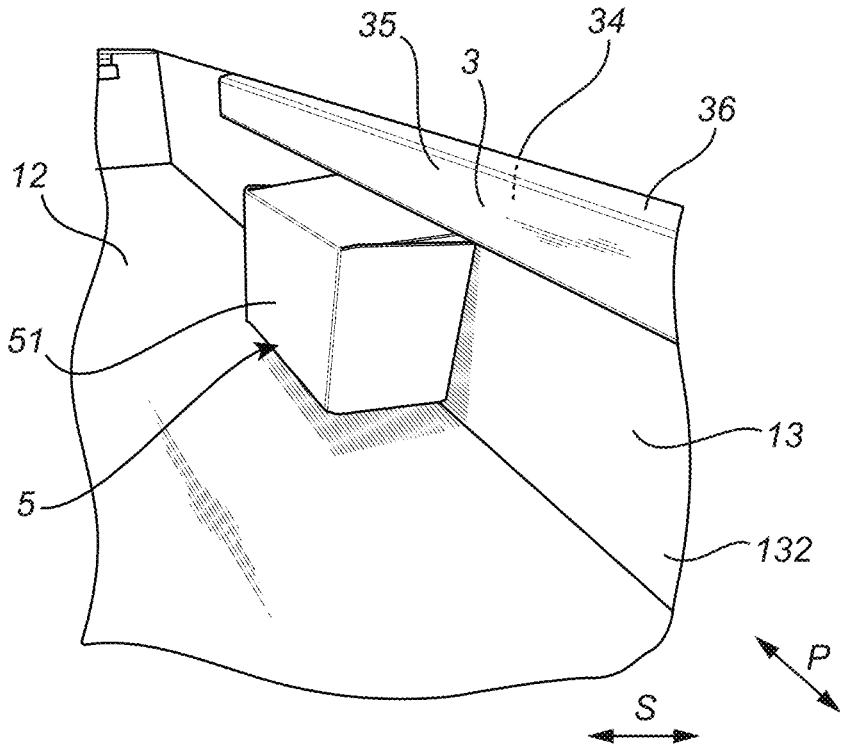

Referring now FIG. 3*a*-*b* where FIG. 3*a* shows a step of packing the components where the sub-packaging 5 is arranged in the box 10, and FIG. 3*b* shows a subsequent step wherein the gutter element 3 is packed in the box 10. In FIG. 3*a* the sub-packaging 5 is placed at the side wall 13 with the attachment flap 52 arranged above the upper edge 131 as in FIG. 2. The gutter element has a first leg 34 and a second leg 35 connected by a third leg 36. The first leg 34 is not visible in FIG. 3*b* as it is hidden by the second leg 35 and the first side wall 13. The first leg 34, second leg 35 and third leg 36 delimits an internal space in the gutter element 3. When the gutter element 3 is placed on first side wall 13 as shown in FIG. 3*b*, the first side wall 13 extends into the internal space of the gutter element 3, and the first leg 34 of the gutter element overlaps with the outer surface 133 while the second leg overlaps the inner surface 132. As the gutter element 3 is placed on the first side wall 13, the second section 523 of the attachment flap is folded down along the outer surface 133 and the first leg 34 and the attachment flap 52 is constrained in the internal space of the gutter-element 3. The attachment flap is thus folded across the upper edge 131 below the gutter element 3. As can be seen, the sub-packaging is suspended above the bottom side 12, showing that the sub-packaging 5 is kept in place in relation to the first side wall 13 by being retained in relation to the gutter element 3.

Figure 4:
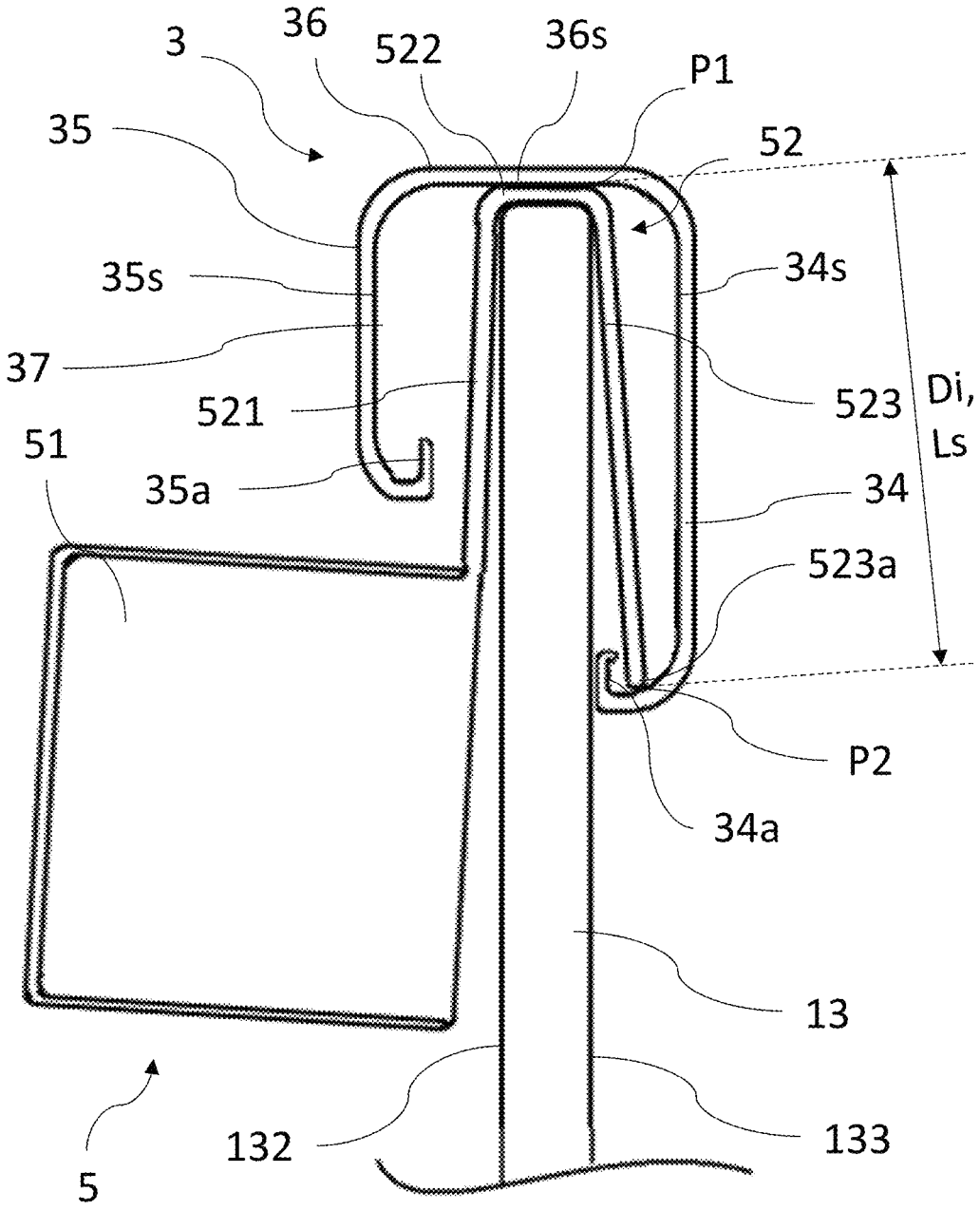
FIG. 4-5 are a cross-sectional view as seen along the primary axis of a sub-packaging with its attachment flap constrained in the internal space above the first side wall, where the box is open and closed respectively.

FIG. 4 shows a cross-section of the situation of FIG. 3*b* in a plane extending perpendicular to the primary axis in a schematic manner. The gutter element 3 is seen to have a U-shaped cross-section formed by the first leg 34, the second leg 35 and the third leg 36 of the gutter element 3. Internal surfaces 34*s*, 35*s*, 36*s* of the first, second and third leg delimit an internal space 37 of the gutter element, which is a concave channel or trench extending along the primary axis P. The attachment flap 52 is folded inside the internal space 37 at the folding zone 522. The second section 523 spans the internal space 37 and an edge of the second section 523 at the folding zone 522 engages the internal surface of the internal space at a first contact position P1 and the distal end 523*a* engages the internal surface at a second contact position P2. The distance between the internal surfaces and the contact points P1 and P2 are shown as distance Di. As can be seen the length of the second section Ls is in this embodiment substantially equal to the distance Di, whereby the second section 523 is constrained in internal space 37 with a minimal tension. In other embodiments the length Ls exceeds the length Di, whereby the second section 523 will be further constrained between the first and second contact position P1, P2. In this embodiment the folding zone 522 is a wide zone which may be pre-made by compressing the attachment flap or scoring the attachment flap along two folding zone lines. In other embodiments, the folding zone may be narrower than shown, reducing the contact area with the internal surface. This could be achieved e.g. by a single scoring line or compressed line in the attachment flap. When the gutter element 3 is retrieved from the first side wall 13, the sub-packaging 5 is still retained with the gutter element 3, as the attachment flap 52 is constrained between the internal surfaces by the tension of the second section 523. The gutter element 3 is here a component with folded edges 34*a*, 35*a* for provide a smooth reinforced edge and this provides an open hem supporting the distal end 523*a* at P2.

Figure 5:
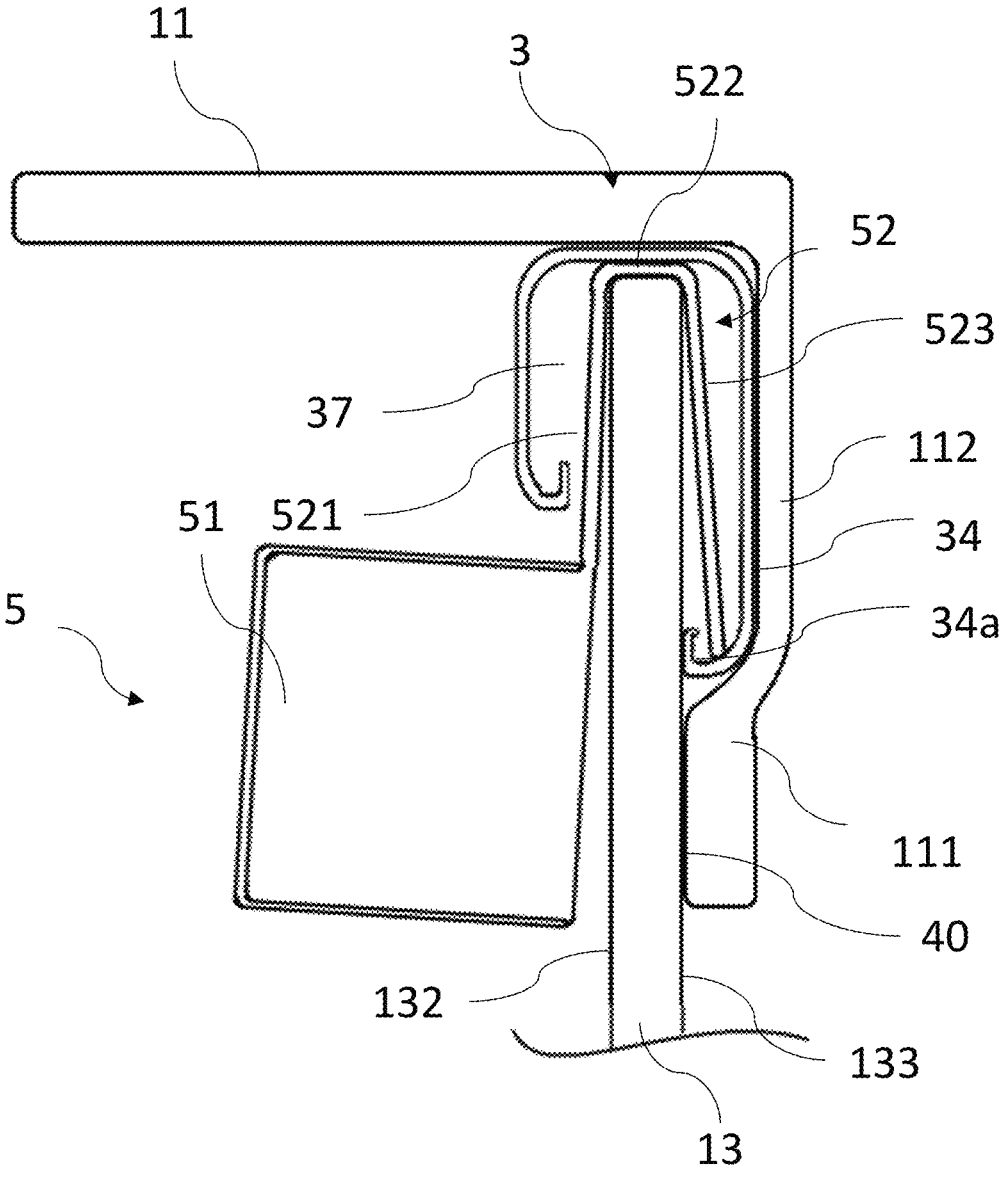

FIG. 5. shows a sub-packaging 5 retained to a gutter element 3 as in FIG. 4 but in the supply condition where the lid 11 of the box is closed. The lid 11 is in contact with the gutter element 3, providing additional fixation of the gutter element 3 to the first side wall 13. The lid has an overlap panel 111 for closing against the outer surface 133 of the first side wall by a strip of glue 40. The overlap panel 111 comprises a zone of reduced thickness 112 which corresponds in size to the size of the first leg 34, reducing the strain on the overlap panel 111 in the supply condition.

Figure 6:
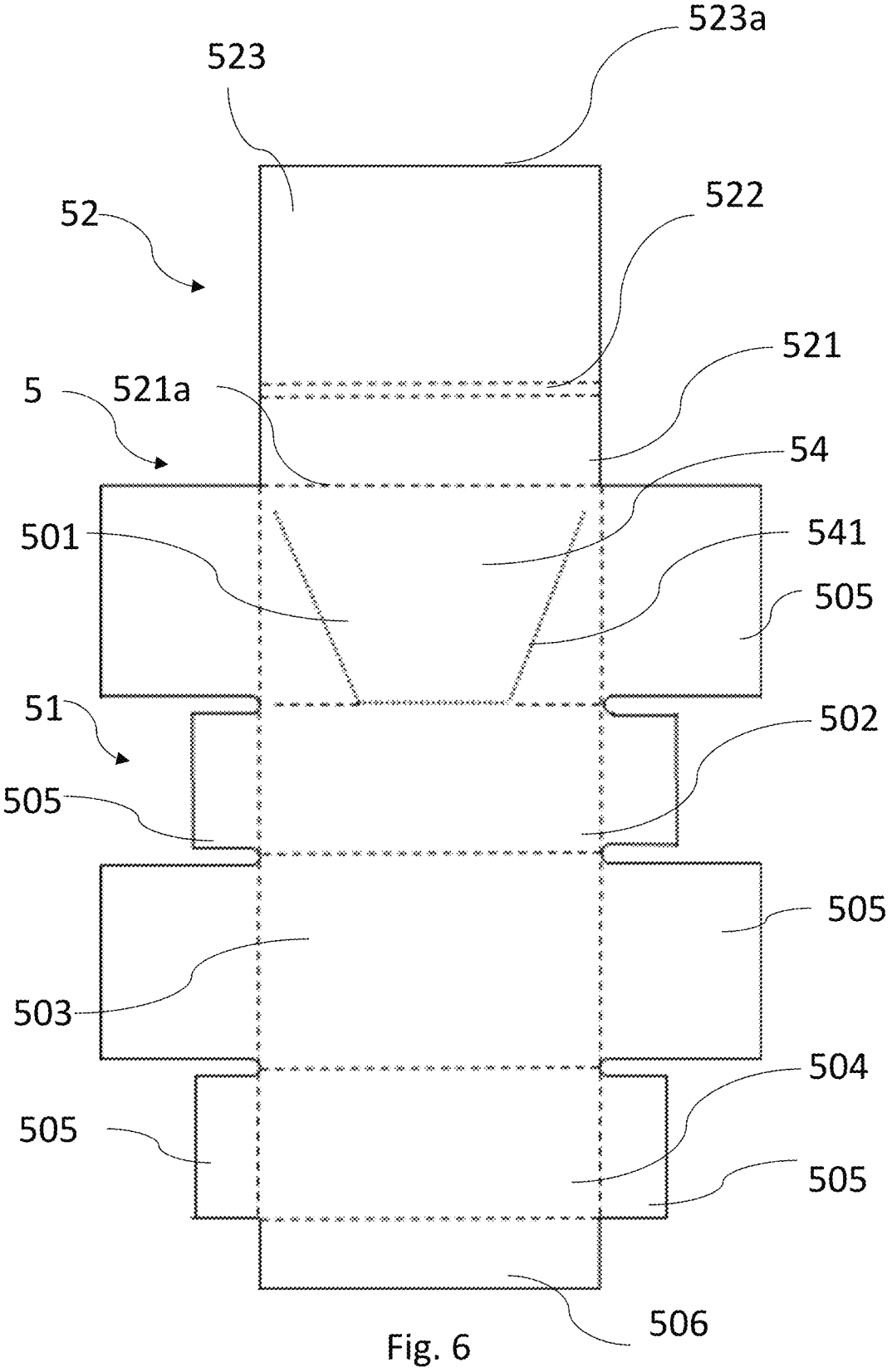
FIG. 6 shows a blank for a sub-packaging box of the five-panel fold type.
Figure 7:
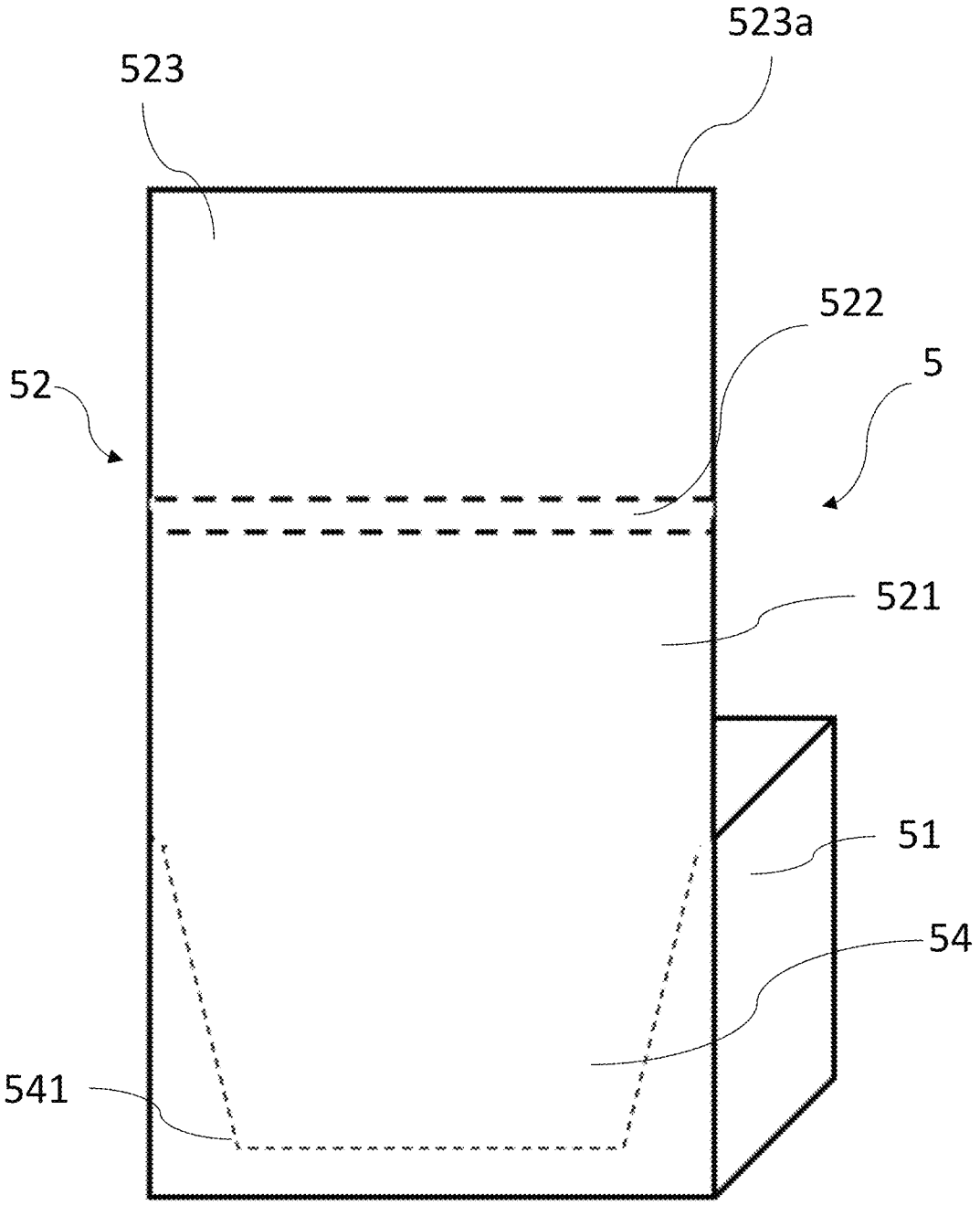
FIG. 7 shows the blank of FIG. 6 in the folded state.

Referring now to FIGS. 6 and 7 which show a blank for a sub-packaging box 5 and sub-packaging box 5 folded from said blank, respectively. The blank 5 is here of the five-panel fold type, where the main body 51 is formed by a lid panel 501, a bottom panel 503 and two side panels 502, 504 as well as six side flaps 505 which will form the remaining two side walls. The dashed lines represent folding lines. In this embodiment the side flaps 505 are to be glued together in a folded state to form the main body 51. As an alternative to glue, the blank could have interlocking panels. The lid panel 501 has overlap panels 506 which in the folded state are glued to the side flaps 505 to close the sub-packaging 5. The blank further has panel 507, which in the folded state extends beneath lid panel 501 and may be glued thereto.

The attachment flap 52 is integrated with main body 51, being an extension of the lid panel 501. The first section 521 and second section 523 are delimited from each other by the folding zone 522 which is indicated by dashed folding lines. The position of the folding zone is pre-determined, i.e. it is provided as part of the blank, which allows the dimensions of the first section 521 and second section 523 to be controlled. In this way it can be ensured that for example the second section 523 of the attachment flap 523, is sized appropriately for it to be constrained in the internal space of the gutter element. It is, however, to be understood that this need not be the case and that the attachment flap may be folded and the folding zone 522 defined by the force applied when placing the first component on the first side wall 13 as described above.

The sub-packaging 5 further has a removable portion 54, which here includes the attachment flap 52 and a portion of the lid panel 501 which is delimited by the break-zone 541. The break zone is here perforation lines 541 which are shown as dotted lines. The removable portion 54 is thus a weakened portion of the lid panel and by tearing the attachment flap 52 from the main body, a part of the lid panel 501 will be torn away with the attachment flap 52, providing an opening in the sub-packaging 5 through which the contents can be retrieved. In this embodiment, the part of the lid panel 501 which is removed covers about 70% of the area of the lid panel 501. The removable portion 54 allows the operator to simply tear the sub-packaging 5 from gutter element 3 in which it is retained by the attachment flap 52, while also opening the sub-packaging 5. The panel 507 may also serve to keep the components from inadvertently falling out of the sub-packaging when the removable part 54 is removed.

Figure 8A:
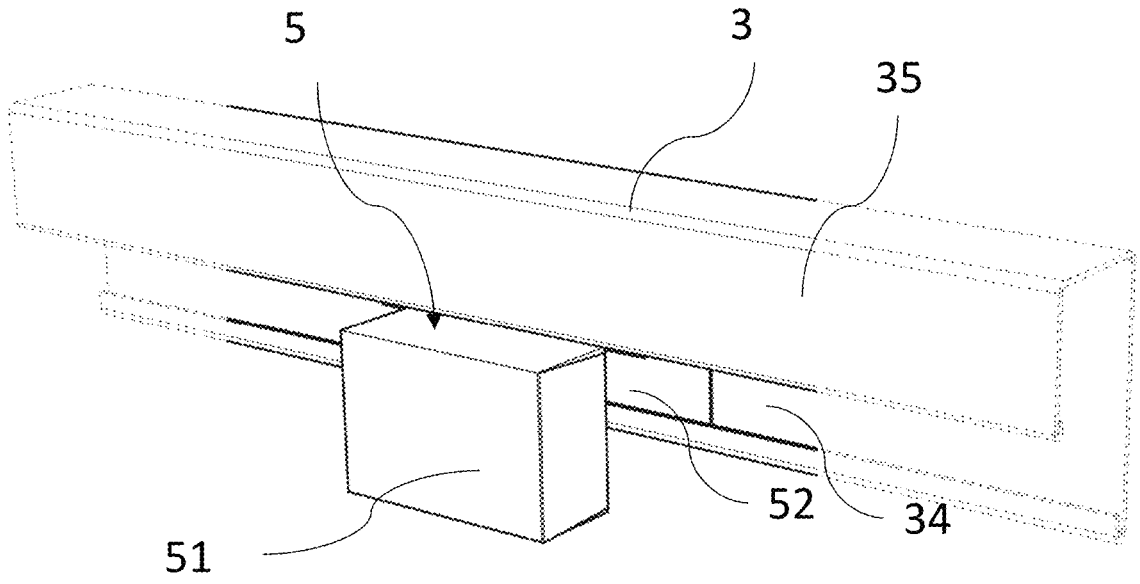
FIG. 8*a* shows the sub-packaging being retained in relation to the first component.
Figure 8B:
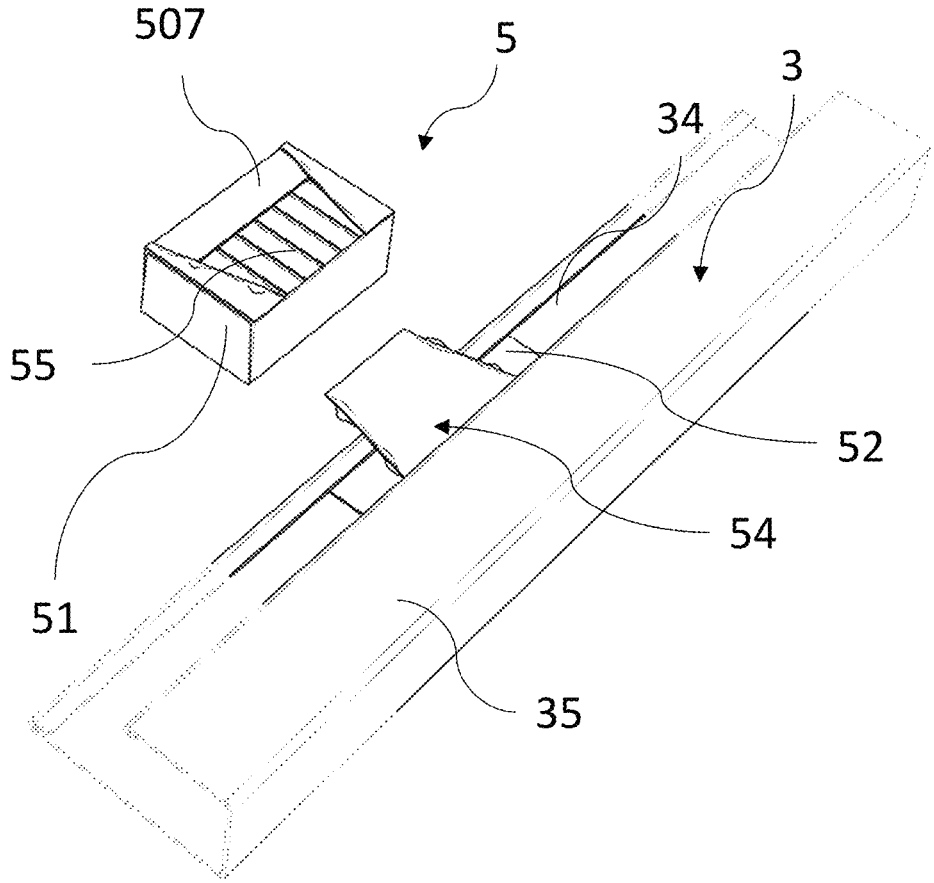
FIG. 8*b* shows the sub-packaging in FIG. 8*a* after having been opened with the removable portion still retained in relation to the first component, FIG. 9 show another embodiment of a sub-packaging having an open side.

Referring now to FIG. 8*a* which shows a gutter element 3 which has been retrieved from the first side wall (not shown). The gutter element 3 is shown in a schematic manner which does not include the entire length of the gutter element 3, and where the portions of the gutter element is drawn with dashed lines. As can be seen the sub-packaging 5 is retained with the gutter element 3 by the attachment flap 52 inside the gutter element 3 and has come off the first side wall together with the gutter element. By tearing the main body 51 of the sub-packaging 5 away from the gutter element, the removable part 54 is left in the gutter element 3 as the sub-packaging is separated at the break-zone 541 as shown in FIG. 8*b*. An opening is provided in the lid panel 501 of the sub-packaging 5 at the same time, from which opening the component collection 55 can be retrieved.

Figure 9:
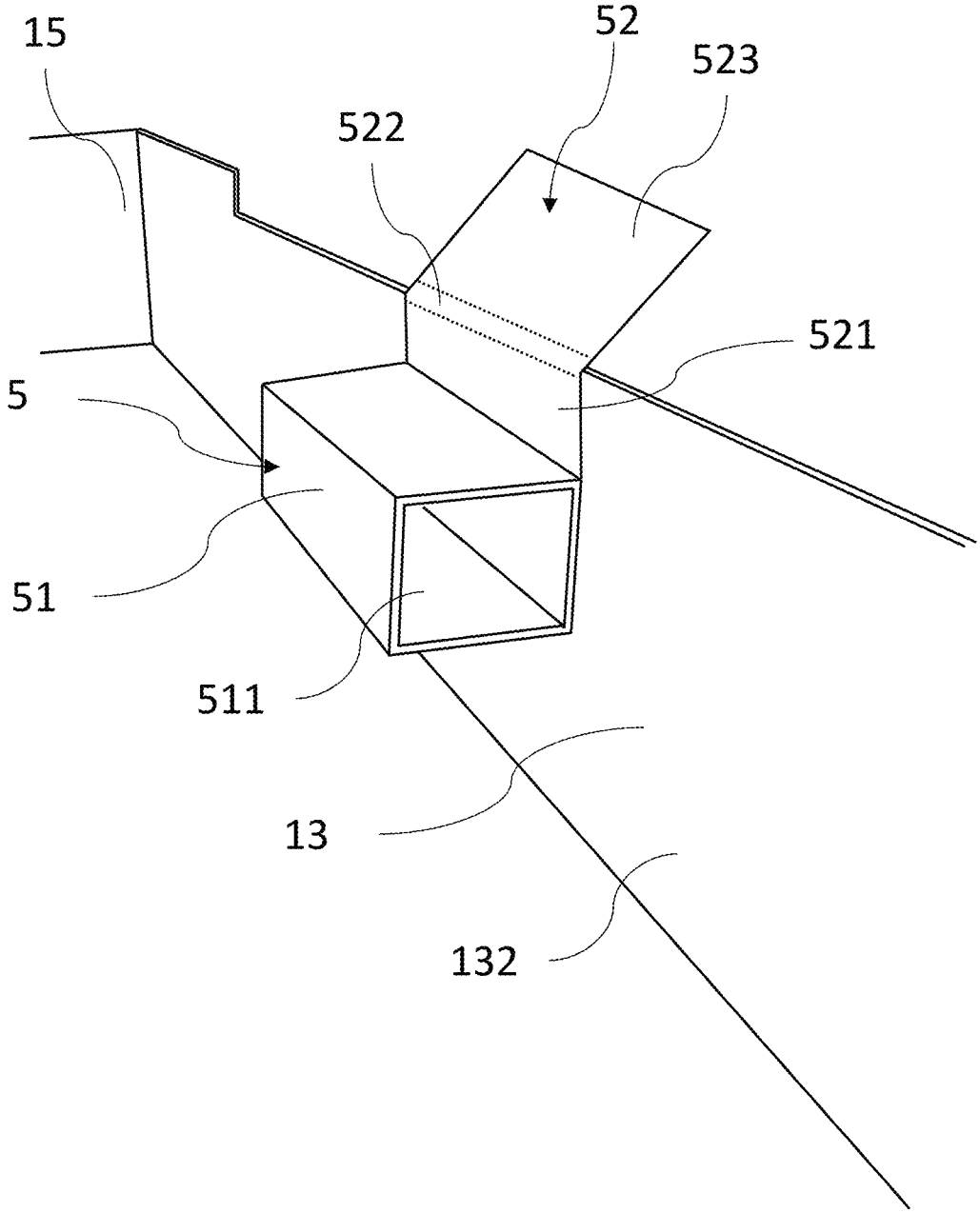

Referring now to FIG. 9 which shows an alternative embodiment of the sub-packaging 5, where the main body 51 is box-shaped and has an open side 511. Open-sided sub-packaging can be used for long components where only part of a component is accommodated in the internal space of the sub-packaging. For example, two pieces of sub-packaging each with one open side 511 can accommodate either end of a long component. Alternatively, or additionally, the component can extend through one or more sub-packaging with two open sides, facing in opposite directions along the primary axis P.

Figure 10:
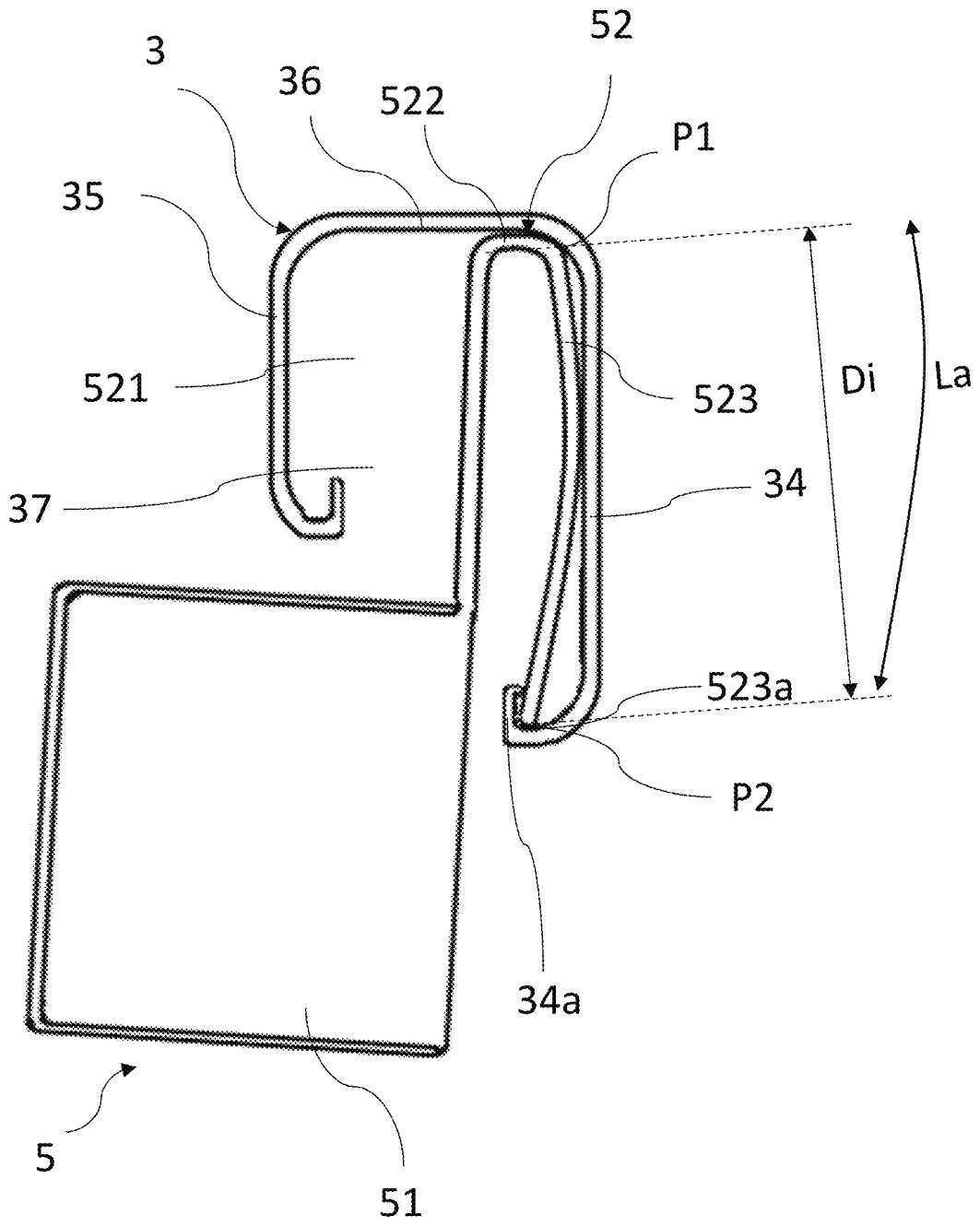
FIG. 10 shows a sub-packaging with a section of the attachment flap constrained in the internal space of a gutter element.

Referring now to FIG. 10 which shows a gutter element 3 which has been removed from the box, where the sub-packaging 5 is still retained in relation to the gutter element 3 by the second section 523 being constrained between a first and second contact position P1, P2. The length of the second section La, as indicated by the displaced trajectory of the curvature of section 523, is seen to exceed the distance Di, and the second section 523 has assumed a deformed shape. This may be achieved with a flexible material such as paperboard.

Figure 11:
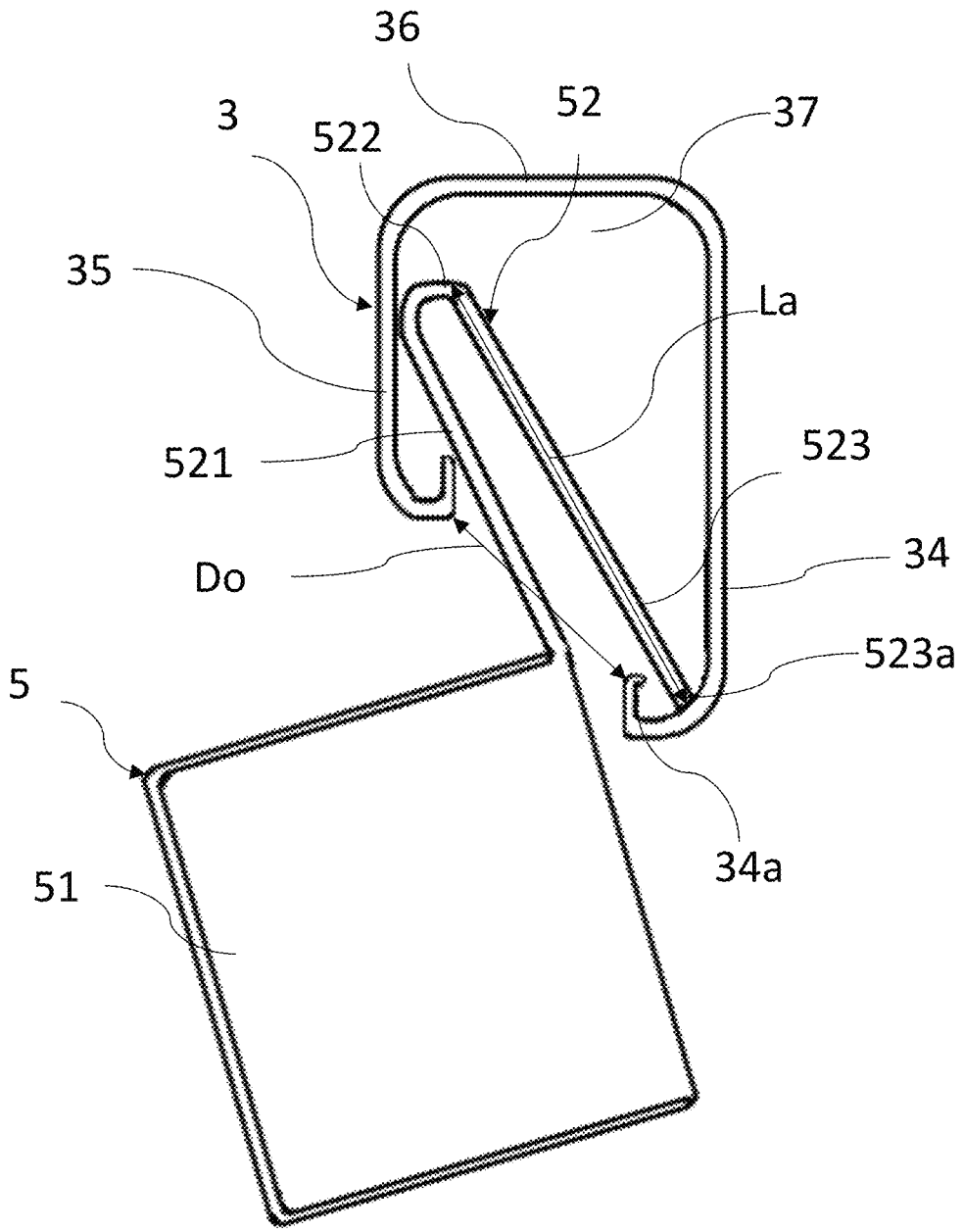
FIG. 11 shows sub-packaging where a section of the attachment flap is longer than an opening in the gutter element.

Referring now to FIG. 11 which shows a gutter element 3 which has been removed from the box, where the sub-packaging 5 is still retained in relation to the gutter element 3 by a second section 523 of the attachment flap having a greater length La than a dimension Do of an opening in the gutter element 3. The length La and dimension Do both extend in the same cross-sectional plane.

Figure 12:
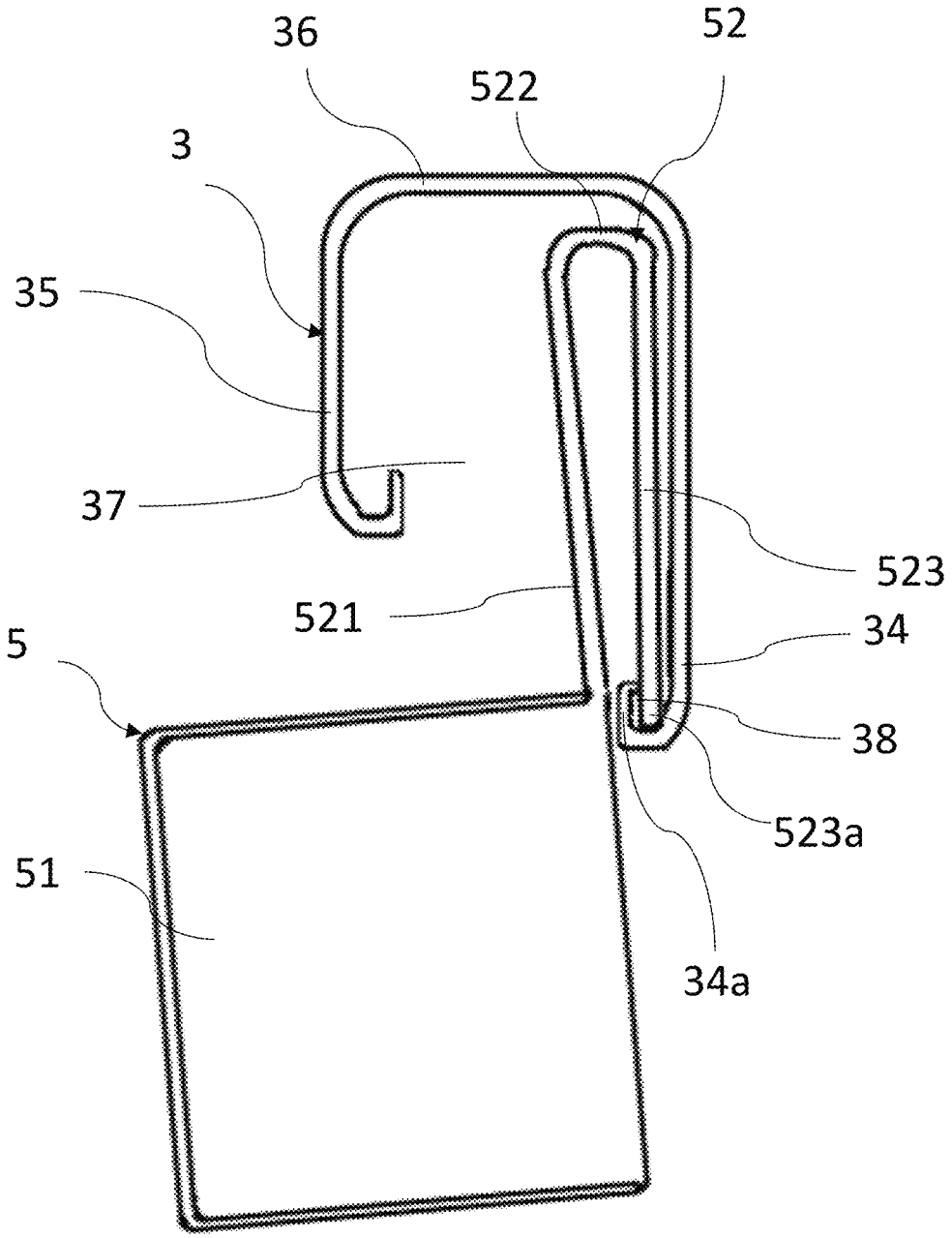
FIG. 12 shows a sub-packaging where the distal end of the attachment flap is retained in an open hem at a free edge of a gutter element.

Referring now to FIG. 12, which shows a second packaging 5 being retained to the gutter element 3 by a distal end 523*a* of the attachment flap being inserted in and engaging an open hem 38 formed at the free edge of the first leg 34 by the fold 34*a* on the free edge. The distal end 523*a* fits snugly into the open hem 38 and is constrained therein, and as the attachment flap is made from corrugated cardboard which is sufficiently rigid it retains its position in the internal space even though folding zone 522 is not in contact with the internal surface of the gutter element.

In each of FIGS. 4, 11 and 12 the distal end 523*a* of the attachment flap 52 may be said to engage the internal surface of the gutter element at a corner formed by two internal surfaces joined at an angle to each other. In an alternative embodiment where the gutter element has a V-shaped cross section an edge of the attachment flap could engage at the corner at the apex of the V-shape.

Figure 13:
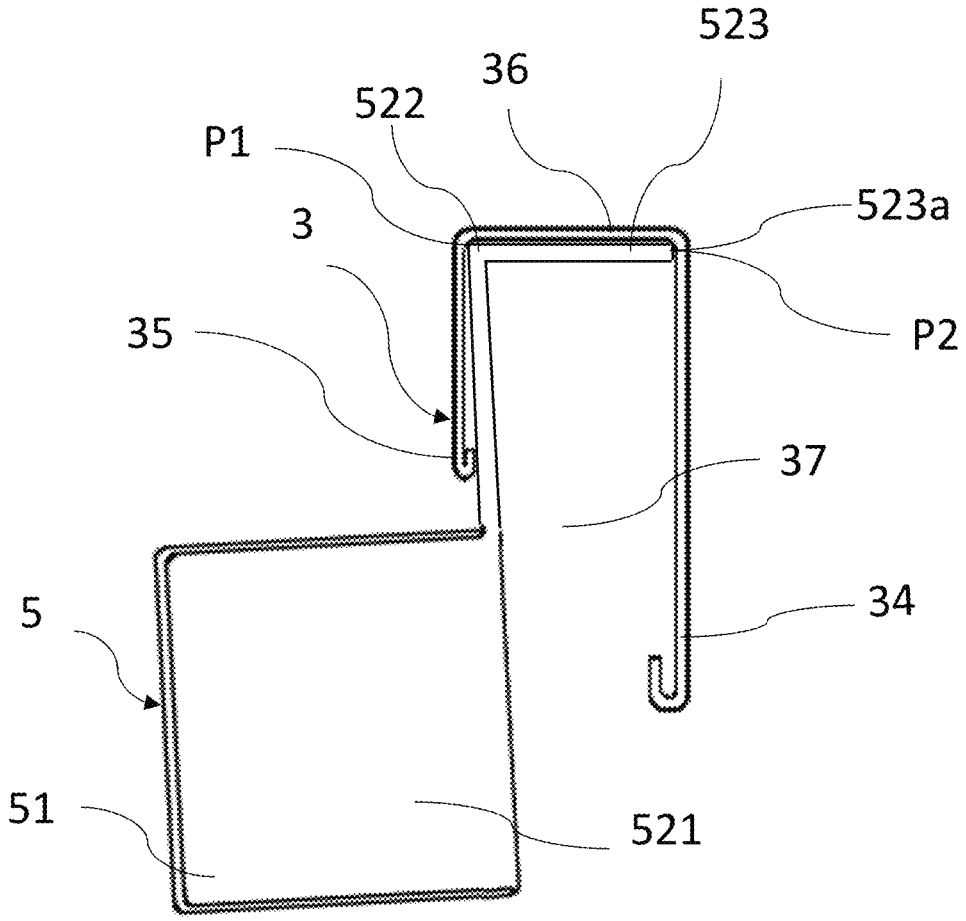
FIG. 13 shows a sub-packaging with a second section of its attachment flap constrained between a first and second legs of a gutter element.

Referring now to FIG. 13 which shows a sub-packaging 5 of corrugated cardboard where the second section 523 spans the internal space of the gutter element 3 constituting the first component between contact positions P1 and P2 along the inner surface of the third leg 36. The position of the folding zone 522 has been pre-selected such that the second section is constrained between the first and second legs 34, 35 of the gutter element.

Figure 14:
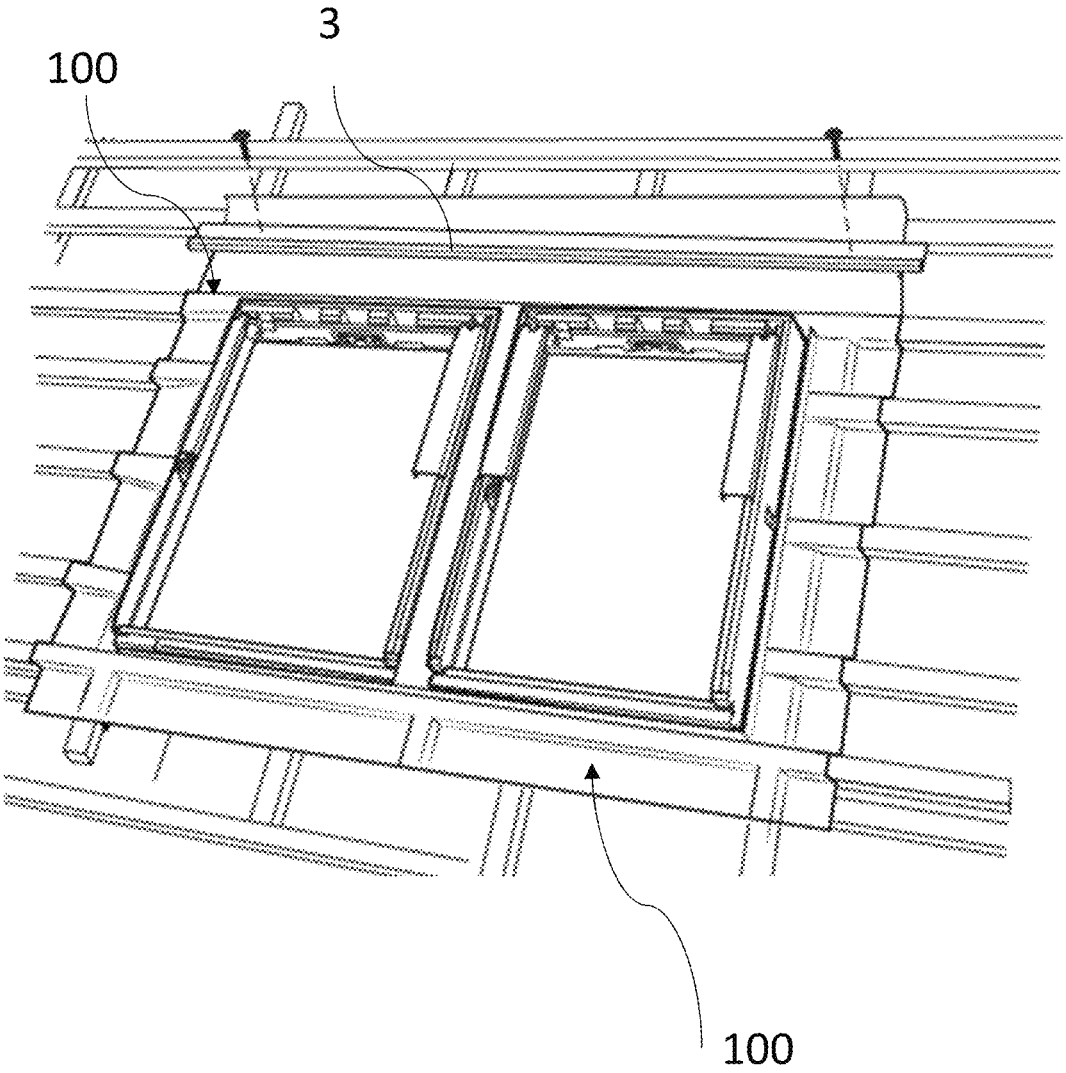
FIG. 14 shows a gutter-element being installed with and above a pair of roof windows.

Referring now to FIG. 14 which shows a gutter element 3 being installed with and above a pair of roof windows 100, the gutter element 3 are exemplary embodiments of components having an internal space in which an attachment flap can be retained as described herein and for being carried by a first side wall of the box. Other components having a cross-sectional shape comprising at least two legs extending at an angle to each other forming a concave internal space may potentially also be used.

Figure 15A:
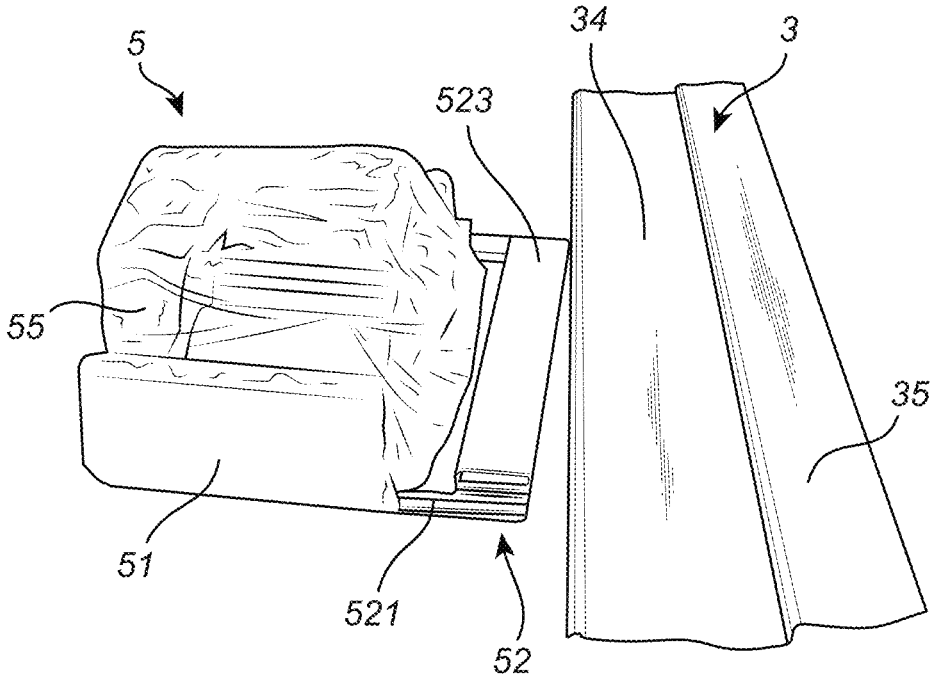
FIGS. 15*a-b* shows an embodiment of the sub-packaging with a thick attachment flap.
Figure 15B:
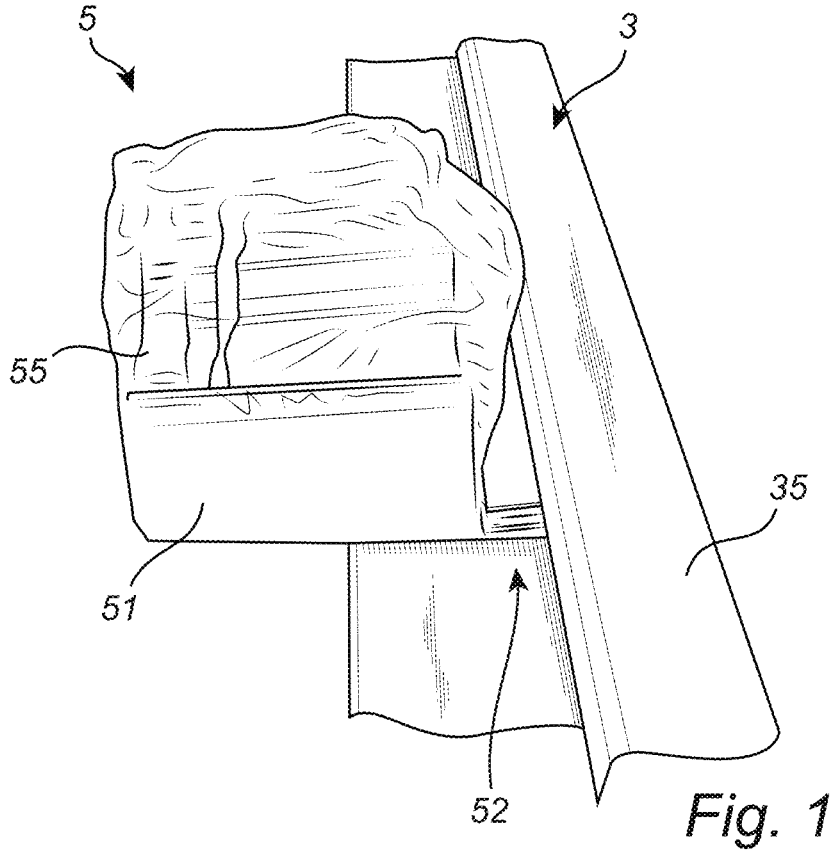

Referring now to FIGS. 15*a* and 15*b* which shows another embodiment of the sub-packaging 5 of corrugated cardboard. A second section 523 of the attachment flap is folded onto the first section 521, to provide a relatively thick portion of the attachment flap 52, which can be fixed between the first leg 34 and second leg 35 of the gutter element 3 as shown in FIG. 15*b*. The thick portion is in this embodiment formed by scoring and folding the attachment flap but could also be formed by attaching an additional piece of cardboard to the attachment flap 52. The thick portion here has a thickness which is twice the thickness of the attachment flap 52. The thickness of the attachment flap is the thickness of the sheet of corrugated cardboard forming the attachment flap. In this embodiment, the thickness of the attachment flap 52 is such that the thick portion fits the internal dimensions of the first component, such as the gutter element 3, such that the attachment flap 52 is retained between the internal surfaces 34*s* and 35*s*. Alternatively, in embodiments where the first component is carried by the first side wall 13, the thickness of the attachment flap is selected such that the thick portion of the attachment flap is retained between the first side wall 13 and a leg of the first component, such as between the inner surface 132 of the first side wall and the inner surface 35*s* of the second leg. In FIGS. 15*a*-*b* the main body 51 of the sub-packaging 5 is an open-type where the component collection 55 is packed in plastic bag which is attached to two flaps of the main body 51, but the embodiment where the attachment flap having a thick portion could also be used for other embodiments of the sub-packaging, such as box-type sub-packaging.

The figures described above are schematic and certain features may appear exaggerated for illustrative purposes.

LIST OF REFERENCE NUMERALS

1 Packed roof window product
2 Window product related components
3 Gutter element
34 First leg of first component
34*a* Folded edge
35 Second leg of first component
35*a* Folded edge
36 Third leg of first component
37 Internal space of first component
38 Open hem
Sub-packaging
51 Main body
501 Top panel
502 Side panel
503 Bottom panel
504 Side panel
505 Side flaps
506 Overlap panel
507 Panel
508 Cut-out
52 Attachment flap
521 First section
521*a* Proximal end of attachment flap
522 Folding zone
523 Second section
523*a* Distal end of attachment flap, edge of attachment flap
54 Removable portion
541 Break zone
55 Component collection
Cardboard box
11 Top side, Lid
111 Overlap panel
112 Zone of reduced thickness
12 Bottom side
13 First side wall
131 Upper edge

132 Inner surface
133 Outer surface
14 Side wall
Side wall
16 Side wall
21 Recess
40 Strip of glue
H Height axis
P Primary axis
S Secondary Axis
P1 First contact position
P2 Second contact position
Di Distance between P1 and P2
Ls Length of section

The invention claimed is:

1. A packed roof window product comprising a plurality of differently sized roof window related product components accommodated in a box, wherein the box in a supply condition has a bottom side and a top side, which bottom side and top side are spaced apart along a height axis, and side walls of the box extend between the bottom side and top side of the box along the height axis, said bottom side, top side and side walls delimiting an internal space of the box, and wherein said side walls include a first side wall which extends along a primary axis, which primary axis is perpendicular to the height axis, and said first side wall has an upper edge extending along the primary axis along the top side, an outer surface facing away from the internal space, and an inner surface facing towards the internal space, wherein a first of said components comprises an internal space, delimited by internal surfaces of the first component, and wherein a second of the components or a collection of components is accommodated by a sub-packaging, the sub-packaging being accommodated in the box, the sub-packaging comprising a main body, which main body delimits an internal space accommodating the second component or component collection, the sub-packaging further comprises an attachment flap projecting from the main body, and that the sub-packaging is retained in relation to the first component by the attachment flap being positioned in the internal space of the first component.

2. The packed roof window product according to claim 1, wherein a section of the attachment flap spans the internal space of the first component, a first edge of the section engaging an internal surface of the internal space of the first component at a first contact position (P1) and a second edge of the section engaging another inner surface of the internal space of the first component at a second contact position (P2), a distance (Di) being defined between the first and second contact positions (P1), (P2), and a length (Ls) being defined between the first and second edges of the section of the attachment flap, wherein the length (Ls) is equal to or greater than the distance (Di).

3. The packed roof window product according to claim 2, wherein the first component is a gutter-shaped element of a covering assembly or of a flashing assembly for a roof window.

4. The packed roof window product according to claim 3, wherein the attachment flap has a proximal end adjacent to the main body of sub-packaging and a distal end opposite to the proximal end and the gutter-shaped first component comprises a U-shaped cross-section and, which U-shaped cross-section is formed by a first leg, a second leg and a third leg, the first leg and second leg being positioned at opposite sides of the internal space of the first component, and the third leg connects the first leg and second leg, wherein an open hem or a closed hem is provided at a free edge of the first leg or second leg, and the distal end of the attachment flap is arranged in the open hem or engaging the closed hem.

5. The packed roof window product according to claim 2, wherein the first component is carried by the first side wall of the box.

6. The packed roof window product according to claim 2, wherein the attachment flap is folded inside the internal space of the first component and wherein a folding zone of the attachment flap constitutes the first edge or the second edge.

7. The packed roof window product according to claim 6, wherein the first component is a gutter-shaped element of a covering assembly or of a flashing assembly for a roof window.

8. The packed roof window product according to claim 7, wherein the attachment flap has a proximal end adjacent to the main body of sub-packaging and a distal end opposite to the proximal end and the gutter-shaped first component comprises a U-shaped cross-section and, which U-shaped cross-section is formed by a first leg, a second leg and a third leg, the first leg and second leg being positioned at opposite sides of the internal space of the first component, and the third leg connects the first leg and second leg, wherein an open hem or a closed hem is provided at a free edge of the first leg or second leg, and the distal end of the attachment flap is arranged in the open hem or engaging the closed hem.

9. The packed roof window product according to claim 1, wherein the first component is a gutter-shaped element of a covering assembly or of a flashing assembly for a roof window.

10. The packed roof window product according to claim 9, wherein the first component is carried by the first side wall of the box.

11. The packed roof window product according to claim 9, wherein the attachment flap has a proximal end adjacent to the main body of sub-packaging and a distal end opposite to the proximal end and the gutter-shaped first component comprises a U-shaped cross-section and, which U-shaped cross-section is formed by a first leg, a second leg and a third leg, the first leg and second leg being positioned at opposite sides of the internal space of the first component, and the third leg connects the first leg and second leg, wherein an open hem or a closed hem is provided at a free edge of the first leg or second leg, and the distal end of the attachment flap is arranged in the open hem or engaging the closed hem.

12. The packed roof window product according to claim 1, wherein the attachment flap has a proximal end adjacent to the main body of sub-packaging and a distal end opposite to the proximal end, wherein the attachment flap is retained or constrained by the distal end of the attachment flap engaging the internal surface of the internal space of the first component at a corner formed by two internal surfaces joined at an angle to each other.

13. The packed roof window product according to claim 12, wherein the first component is carried by the first side wall of the box.

14. The packed roof window product according to claim 1, wherein the first component is carried by the first side wall of the box.

15. The packed roof window product according to claim 14, wherein the first component is carried by the upper edge of the first side wall, and the attachment flap is folded across the upper edge from the inner surface to the outer surface of the first side wall.

16. The packed roof window product according to claim 1, wherein at least one of the box and the sub-packaging is made from a paper-based material.

17. The packed roof window product according to claim 1, wherein the attachment flap is integrally formed with the main body of the sub-packaging.

18. The packed roof window product according to claim 1, wherein the sub-packaging comprises a removable portion configured for being separated from the rest of the sub-packaging by a break-zone.

19. A method for packing a packed roof window product comprising a plurality of differently sized roof window related product components in a box, wherein the box in a supply condition has a bottom side and a top side, which bottom side and top side are spaced apart along a height axis, and side walls of the box extend between the bottom side and top side of the box in the height direction, said bottom side, top side and side walls delimiting an internal space of the box, and wherein the side walls include a first side wall which extends along a primary axis, which primary axis is perpendicular to the height axis, and said first side wall has an upper edge extending along the primary axis along the top side, an outer surface facing away from the internal space, and an inner surface facing towards the internal space, wherein a first of said components comprises an internal space, delimited by internal surfaces of the first component, and wherein a second of the components or a collection of components is accommodated by a sub-packaging, the sub-packaging being accommodated in the box, the sub-packaging comprising a main body, which main body delimits an internal space accommodating the second component or component collection, and an attachment flap projecting from the main body, which method comprises the steps of:

arranging the sub-packaging in the box with the attachment flap extending across the first side wall from the inner surface to the outer surface, arranging the first component on the first side wall with the attachment flap positioned in the internal space of the first component, and, retaining the sub-packaging in relation to the first component.

20. A method of unpacking a packed roof window product comprising a plurality of differently sized roof window related product components accommodated in a box, wherein the box in a supply condition has a bottom side and a top side, which bottom side and top side are spaced apart along a height axis, and side walls of the box extend between the bottom side and top side of the box along the height axis, said bottom side, top side and side walls delimiting an internal space of the box, and wherein the side walls include a first side wall which extends along a primary axis, which primary axis is perpendicular to the height axis, and said first side wall has an upper edge extending along the primary axis along the top side, an outer surface facing away from the internal space, and an inner surface facing towards the internal space, wherein a first of said components comprises an internal space, delimited by internal surfaces of the first component, and wherein a second of the components or a collection of components is accommodated by a sub-packaging, the sub-packaging being accommodated in the box, the sub-packaging comprising a main body, which main body delimits an internal space accommodating the second component or component collection, the sub-packaging further comprises an attachment flap projecting from the main body, and that the sub-packaging is retained in relation to the first component by the attachment flap being positioned in the internal space of the first component, which method comprises the steps of:

removing the first component from the box, the sub-packaging being retained in relation to the first component, and removing at least a main body of the sub-packaging from the first component.

* * * * *